US010685601B2

(12) United States Patent
Yamamoto

(10) Patent No.: US 10,685,601 B2
(45) Date of Patent: Jun. 16, 2020

(54) PIXEL CIRCUIT AND DISPLAY UNIT

(71) Applicant: JOLED Inc., Tokyo (JP)

(72) Inventor: Tetsuro Yamamoto, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 16/239,875

(22) Filed: Jan. 4, 2019

(65) Prior Publication Data

US 2019/0259329 A1 Aug. 22, 2019

(30) Foreign Application Priority Data

Feb. 22, 2018 (JP) ..... 2018-029573

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0819* (2013.01); *G09G 2300/0852* (2013.01); *G09G 2300/0861* (2013.01); *G09G 2320/0233* (2013.01); *G09G 2320/043* (2013.01)

(58) Field of Classification Search
CPC ..... G09G 2320/0233; G09G 2320/043; G09G 2300/0861; G09G 3/3258
See application file for complete search history.

(56) References Cited

U.S. PATENT DOCUMENTS

2014/0009512 A1* 1/2014 Lee ..... G09G 5/02 345/690
2016/0253959 A1* 9/2016 Sun ..... G09G 3/2003 345/212
2017/0270867 A1* 9/2017 Zhu ..... G09G 3/3233
2019/0043426 A1* 2/2019 Zhang ..... G09G 3/3225

FOREIGN PATENT DOCUMENTS

JP 2006-030921 A 2/2006
JP 2006-133543 A 5/2006

* cited by examiner

*Primary Examiner* — Abbas I Abdulselam
(74) *Attorney, Agent, or Firm* — Michael Best & Friedrich LLP

(57) ABSTRACT

A pixel circuit includes a driving transistor, a write transistor, a first switching transistor, a second switching transistor, a first storage capacitor, and a second storage capacitor. The driving transistor controls a current flowing in a light-emitting device. The write transistor controls application of a signal voltage to a gate of the driving transistor. The first switching transistor controls a gate voltage of the driving transistor upon correction operation that allows a gate-source voltage of the driving transistor to come close to a threshold voltage of the driving transistor. The second switching transistor is provided at a path between first and second terminals. The first storage capacitor is provided at a path between the gate of the driving transistor and the first terminal. The second storage capacitor is provided at a path between the gate of the driving transistor and the second terminal.

8 Claims, 18 Drawing Sheets

PIXEL CIRCUIT AND DISPLAY UNIT

CROSS REFERENCE TO RELATED APPLICATIONS

This application claims the benefit of Japanese Priority Patent Application JP 2018-029573 filed on Feb. 22, 2018, the entire contents of which are incorporated herein by reference.

BACKGROUND

The disclosure relates to a pixel circuit and a display unit.

In the technical field of display units that display an image, a display unit utilizing an electric current-driven optical device as a light-emitting device of a pixel has been commercialized in recent years. Such an optical device includes an organic electroluminescence (EL) device, for example. The current-driven optical device has emission luminance which varies depending on a value of a flowing current. The organic EL device is a self-light-emitting device, and thus differs from a device such as a liquid crystal device. The display unit utilizing the organic EL device (organic EL display unit) therefore does not need a light source (backlight), thus is more lightweight, thinner, and higher in luminance than a liquid crystal display unit that needs a light source. Further, the organic EL device has a very high response speed of about several micro seconds, thus preventing the occurrence of an afterimage during display of a motion picture. Hence, the organic EL display unit is expected to be a mainstream next-generation flat panel display.

An active-matrix organic EL display unit has a configuration in which each scanning line is sequentially scanned, and a signal voltage corresponding to an image signal is sampled and is written into a storage capacitor. In other words, the line sequential scanning allows for the writing operation of the signal voltage. Further, in the organic EL display unit in which a threshold voltage and mobility of a driving transistor differ for each pixel, the organic EL device may possibly have irregular luminance, impairing uniformity of a screen when. Therefore, the active-matrix organic EL display unit performs correction operation that reduces the irregular luminance caused by the irregular threshold voltage and the irregular mobility of the driving transistor, in addition to the line sequential scanning. For example, reference is made to Japanese Unexamined Patent Application Publication Nos. 2006-133543 and 2006-030921.

SUMMARY

What is demanded is to further reduce irregular luminance by means of correction operation performed by an organic electroluminescence display unit.

It is desirable to provide a pixel circuit and a display unit that make it possible to further reduce irregular luminance.

A pixel circuit according to one embodiment of the technology includes a driving transistor that controls a current flowing in a light-emitting device, and a write transistor that controls application of a signal voltage to a gate of the driving transistor. The signal voltage corresponds to an image signal. The pixel circuit further includes a first switching transistor that controls a gate voltage of the driving transistor upon correction operation that allows a gate-source voltage of the driving transistor to come close to a threshold voltage of the driving transistor, and a second switching transistor that is provided at an electrically conductive path between a first terminal of the driving transistor and a second terminal of the write transistor. The first terminal of the driving transistor is adjacent to the light-emitting device. The second terminal of the write transistor is adjacent to the driving transistor. The pixel circuit further includes a first storage capacitor provided at an electrically conductive path between the gate of the driving transistor and the first terminal, and a second storage capacitor provided at an electrically conductive path between the gate of the driving transistor and the second terminal.

A display unit according to one embodiment of the technology is provided with a plurality of pixels and a driving circuit, in which the plurality of pixels each include a light-emitting device and a pixel circuit, and the driving circuit drives the plurality of pixels. In the display unit, the pixel circuit includes the same elements as those of the above-described pixel circuit.

BRIEF DESCRIPTION OF THE DRAWINGS

The accompanying drawings are included to provide a further understanding of the disclosure, and are incorporated in and constitute a part of this specification. The drawings illustrate example embodiments and, together with the specification, serve to explain the principles of the disclosure.

DETAILED DESCRIPTION

Figure 1:
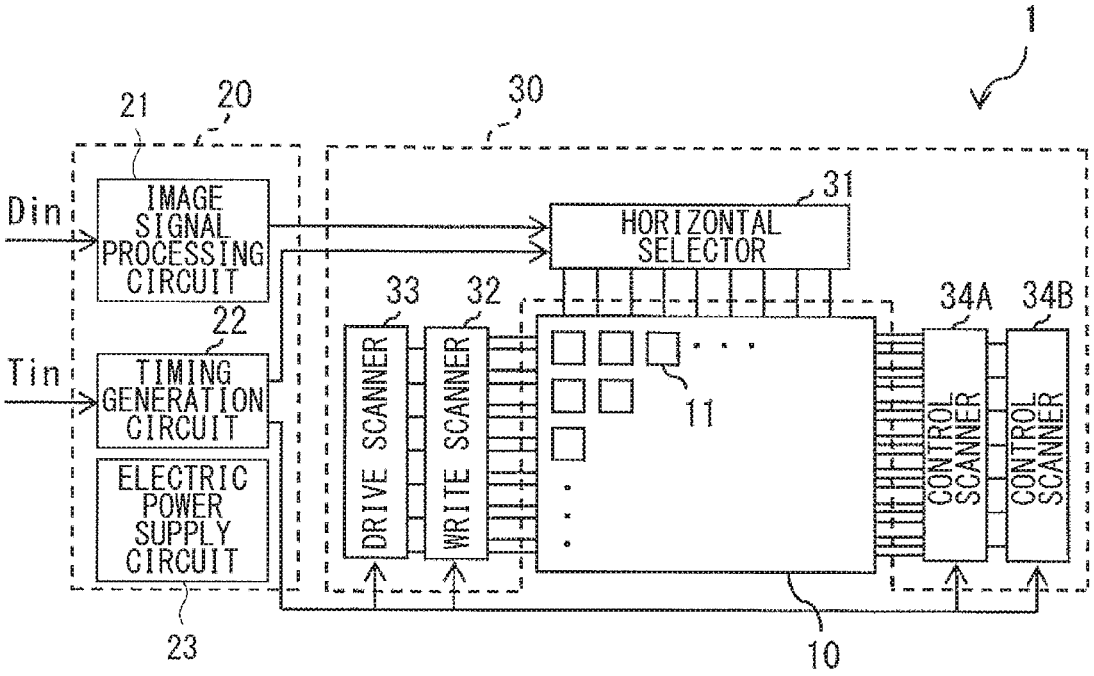
FIG. 1 is a schematic configuration diagram of a display unit according to one embodiment of the disclosure.

Some example embodiments of the disclosure are described below in detail with reference to the accompanying drawings. It is to be noted that the following description is directed to illustrative examples of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiments which are not recited in a most-generic independent claim of the disclosure are optional and may be provided on an as-needed basis. The drawings are schematic and are not intended to be drawn to scale. It is to be noted that the like elements are denoted with the same reference numerals, and any redundant description thereof will not be described in detail. It is to be noted that the description is given in the following order.

1. First Example Embodiment (Display Unit)
2. Second Example Embodiment (Display Unit)
3. Third Example Embodiment (Display Unit)
4. Modification Example of Third Embodiment (Display Unit)
5. Fourth Example Embodiment (Display Unit)
6. Fifth Example Embodiment (Display Unit)
7. Application Example (Electronic Apparatus)

1. First Example Embodiment

Configuration

FIG. 1 illustrates a schematic configuration of a display unit 1 according to an embodiment of the disclosure. The display unit 1 may include a pixel array 10, a controller 20, and a driver 30, for example. The controller 20 and the driver 30 correspond to a specific but non-limiting example of a "driving circuit" according to one embodiment of the disclosure. The pixel array 10 may include a plurality of pixels 11 that are disposed in matrix. The controller 20 and the driver 30 may drive the plurality of pixels 11 on the basis of an image signal Din and a synchronizing signal Tin which are supplied from the outside.

Pixel Array 10

Figure 2:
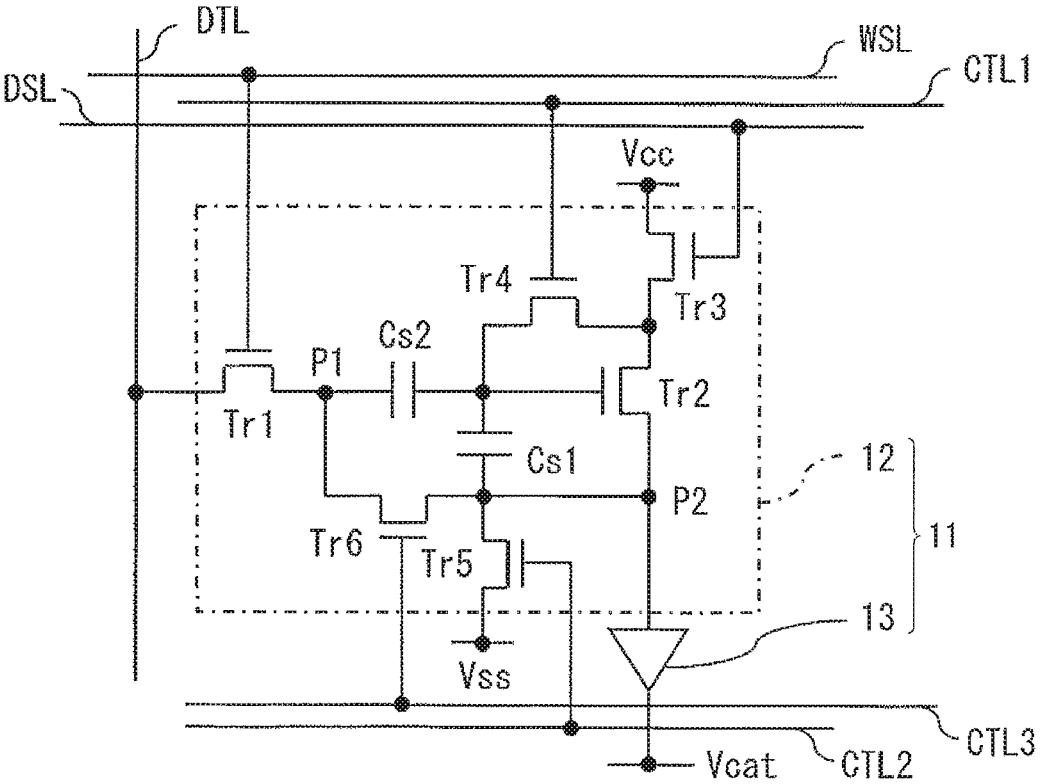
FIG. 2 illustrates an example of a circuit configuration of each of pixels illustrated in FIG. 1.

FIG. 2 illustrates an example of a circuit configuration of each of the pixels 11 included in the pixel array 10. The controller 20 and the driver 30 may perform active-matrix driving of each of the pixels to thereby allow the pixel array 10 to display an image based on the image signal Din and the synchronizing signal Tin which are supplied from the outside. The pixel array 10 may include, for example, a plurality of scanning lines WSL, a plurality of power control lines DSL, a plurality of control lines CTL1, CTL2, and CTL3, and a plurality of signal lines DTL. The plurality of scanning lines WSL, the plurality of power control lines DSL, and the control lines CTL1, CTL2, and CTL3 may extend in a row direction in the circuit configuration of the pixel 11. The plurality of signal lines DTL may extend in a column direction in the circuit configuration of the pixel 11. The pixel array 10 may further include the plurality of pixels 11. The plurality of pixels 11 may be each provided at each intersection between corresponding one of the scanning lines WSL and corresponding one of the signal lines DTL.

The scanning line WSL may be used for selecting each of the pixels 11. The scanning line WSL may supply a selection pulse to each of the pixels 11. The scanning line WSL may select each of the pixels 11 per predetermined unit (e.g., a pixel row) by means of the selection pulse. The signal line DTL may be used for supplying, to each of the pixels 11, a signal voltage Vsig in accordance with the image signal Din. The signal line DTL may supply, to each of the pixels 11, a data pulse including the signal voltage Vsig. The power control line DSL may supply a control pulse to each of the pixels 11. The control pulse may control electric power supply to each of the pixels 11. In a specific but non-limiting example, the power control line DSL may supply, to each of the pixels 11, a control pulse that controls on-off of a switching transistor Tr3. The switching transistor Tr3 will be described later. The control line CTL1 may supply, to each of the pixels 11, a control pulse that controls on-off of a switching transistor Tr4. The switching transistor Tr4 will be described later. The control line CTL2 may supply, to each of the pixels 11, a control pulse that controls on-off of a switching transistor Tr5. The switching transistor Tr5 will be described later. The control line CTL3 may supply, to each of the pixels 11, a control pulse that controls on-off of a switching transistor Tr6. The switching transistor Tr6 will be described later.

Each of the pixels 11 may include, for example, a pixel circuit 12 and an organic EL device 13. In one embodiment, the organic EL device 13 corresponds to a specific but non-limiting example of a "light-emitting device". The organic EL device 13 may include a configuration in which an anode electrode, an organic layer, and a cathode electrode are stacked in order, for example. The organic EL device 13 may include a device capacitor (i.e., a device capacitor Cel described later). The pixel circuit 12 may control light emission and light extinction of the organic EL device 13. The pixel circuit 12 may serve to store a voltage that is written into corresponding one of the pixels 11 by means of write scanning described later. The pixel circuit 12 may include, for example, a write transistor Tr1, a driving transistor Tr2, the switching transistors Tr3, Tr4, Tr5, and Tr6, and storage capacitors Cs1 and Cs2.

In one embodiment, the switching transistor Tr3 corresponds to a specific but non-limiting example of a "third switching transistor". In one embodiment, the switching transistor Tr4 corresponds to a specific but non-limiting example of a "first switching transistor". In one embodiment, the switching transistor Tr5 corresponds to a specific but non-limiting example of a "fourth switching transistor". In one embodiment, the switching transistor Tr6 corresponds to a specific but non-limiting example of a "second switching transistor". In one embodiment, the storage capacitor Cs1 corresponds to a specific but non-limiting example of a "first storage capacitor". In one embodiment, the storage capacitor Cs2 corresponds to a specific but non-limiting example of a "second storage capacitor".

The write transistor Tr1 may control application of the signal voltage Vsig to a gate of the driving transistor Tr2. The signal voltage Vsig may correspond to the image signal Din. In a specific but non-limiting example, the write transistor Tr1 may sample a voltage of the signal line DTL. The write transistor Tr1 may also write the voltage obtained by the sampling into the gate of the driving transistor Tr2 through the storage capacitor Cs2. The driving transistor Tr2 may be coupled in series to the organic EL device 13. The driving transistor Tr2 may drive the organic EL device 13. The driving transistor Tr2 may control a current that flows in the organic EL device 13 in accordance with the level of the voltage sampled by the write transistor Tr1.

The storage capacitor Cs1 may store a predetermined voltage between a gate and a source of the driving transistor Tr2. The storage capacitor Cs2 may store a predetermined voltage between a terminal P1 of the write transistor Tr1 and the gate of the driving transistor Tr2. The terminal P1 of the write transistor Tr1 may be adjacent to the driving transistor Tr2. The storage capacitor Cs1 is provided at an electrically conductive path between the gate of the driving transistor Tr2 and an anode of the organic EL device 13. In other words, the storage capacitor Cs1 is provided at the electrically conductive path between the gate of the driving transistor Tr2 and a terminal P2 of the driving transistor Tr2. The terminal P2 of the driving transistor Tr2 is adjacent to the organic EL device 13. The storage capacitor Cs2 is provided at an electrically conductive path between the terminal P1 of the write transistor Tr1 and the gate of the driving transistor Tr2.

The capacity of the storage capacitor Cs1 and the capacity of the storage capacitor Cs2 may be equal to each other, for example. The switching transistor Tr3 may control a current that flows in the driving transistor Tr2. The switching transistor Tr3 may be provided at an electrically conductive path between a fixed voltage line VCC and a terminal of the driving transistor Tr2. The terminal of the driving transistor Tr2 may be adjacent to the fixed voltage line VCC. Therefore, the switching transistor Tr3 may supply a predetermined current to the driving transistor Tr2 when the switching transistor Tr3 is turned ON. The switching transistor Tr4 controls a gate voltage Vg of the driving transistor Tr2 upon correction operation that allows a gate-source voltage of the driving transistor Tr2 to come close to a threshold voltage Vth of the driving transistor Tr2. The switching transistor Tr4 is provided at an electrically conductive path between the gate of the driving transistor Tr2 and a terminal of the driving transistor Tr2. The terminal of the driving transistor Tr2 is adjacent to the switching transistor Tr3.

The switching transistor Tr5 may control application of a voltage of a fixed voltage line VSS to the terminal P2 of the driving transistor Tr2. The terminal P2 may be adjacent to the organic EL device 13. The switching transistor Tr5 is provided at an electrically conductive path between the terminal P2 of the driving transistor Tr2 and the fixed voltage line VSS. The terminal P2 of the driving transistor Tr2 is adjacent to the organic EL device 13. The switching transistor Tr6 is provided at an electrically conductive path between the terminal P2 of the driving transistor Tr2 and the terminal P1 of the write transistor Tr1. The terminal P1 of the write transistor Tr1 is adjacent to the organic EL device 13. Terminal P2 of the driving transistor Tr2 is adjacent to the organic EL device 13.

The write transistor Tr1, the driving transistor Tr2, and the switching transistors Tr3, Tr4, Tr5, and Tr6 may each include, for example, an n-channel metal oxide semiconductor (MOS) thin film transistor (TFT). Alternatively, the write transistor Tr1 and the switching transistors Tr3, Tr4, Tr5, and Tr6 may each include, for example, a p-channel MOS TFT. The following description will be given on the assumption that these transistors are of enhancement type. However, these transistors may be alternatively of depression type.

Each of the signal lines DTL may be coupled to an unillustrated output end of a horizontal selector 31 described later and to one of a source or a drain of the write transistor Tr1. Each of the scanning lines WSL may be coupled to an unillustrated output end of a write scanner 32 and to a gate of the write transistor Tr1. Each of the power control lines DSL may be coupled to an unillustrated output end of a drive scanner 33 described later and to a gate of the switching transistor Tr3.

Each of the control lines CTL1 may be coupled to an unillustrated output end of a control scanner 34A described later and to a gate of the switching transistor Tr4. Each of the control lines CTL2 may be coupled to an unillustrated output end of a control scanner 34B described later and to a gate of the switching transistor Tr5. Each of the control lines CTL3 may be coupled to an unillustrated output end of the control scanner 34A described later and to a gate of the switching transistor Tr6.

The gate of the write transistor Tr1 may be coupled to the scanning line WSL. One of the source or the drain of the write transistor Tr1 may be coupled to the signal line DTL. The other (i.e., the terminal P1), of the source and the drain of the write transistor Tr1, that is not coupled to the signal line DTL may be coupled to the storage capacitor Cs2. The driving transistor Tr2 may include a gate that is coupled to the storage capacitor Cs2. One of a source or a drain of the driving transistor Tr2 may be coupled to one of a source or a drain of the switching transistor Tr3. The other (i.e., the terminal P2), of the source and the drain of the driving transistor Tr2, that is not coupled to the switching transistor Tr3 may be coupled to the anode of the organic EL device 13.

The gate of the switching transistor Tr3 may be coupled to the power control line DSL. One of the source or the drain of the switching transistor Tr3 may be coupled to the fixed voltage line VCC. The other of the source and the drain of the switching transistor Tr3, that is not coupled to the fixed voltage line VCC may be coupled to one of the source or the drain of the driving transistor Tr2. The gate of the switching transistor Tr4 may be coupled to the control line CTL1. One of a source or a drain of the switching transistor Tr4 may be coupled to the driving transistor Tr2. The other of the source and the drain of the switching transistor Tr4, that is not coupled to gate of the driving transistor Tr2 may be coupled to one of the source or the drain of the driving transistor Tr2 (i.e., a terminal different from the terminal P2).

The gate of the switching transistor Tr5 may be coupled to the control line CTL2. One of a source or a drain of the switching transistor Tr5 may be coupled to the fixed voltage line VSS. The other of the source and the drain of the switching transistor Tr5, that is not coupled to the fixed voltage line VSS may be coupled to one of the source or the drain of the switching transistor Tr5 (i.e., the terminal P2). The gate of the switching transistor Tr6 may be coupled to the control line CTL3. One of a source or a drain of the switching transistor Tr6 may be coupled to one of the source or the drain of the write transistor Tr1 (i.e., the terminal P1). The other of the source and the drain of the switching transistor Tr6, that is not coupled to the terminal P1 may be coupled to one of the source or the drain of the driving transistor Tr2 (i.e., the terminal P2).

The storage capacitor Cs1 may include one end that is coupled to the gate of the driving transistor Tr2. The storage capacitor Cs1 may include the other end that is coupled to one of the source or the drain of the driving transistor Tr2 (i.e., the terminal P2). The storage capacitor Cs2 may include one end that is coupled to one of the source or the drain of the write transistor Tr1 (i.e., the terminal P1). The storage capacitor Cs2 may include the other end that is coupled to the gate of the driving transistor Tr2. The anode of the organic EL device 13 may be coupled to one of the source or the drain of the driving transistor Tr2 (i.e., the terminal P2). The organic EL device 13 may include a cathode that is coupled to a cathode voltage line Vcat.

The driver 30 may include, for example, the horizontal selector 31, the write scanner 32, the drive scanner 33, and the control scanners 34A and 34B.

The horizontal selector 31 may apply an analog signal voltage Vsig to each of the signal lines DTL in response to (in synchronization with) an input of a control signal, for example. The analog signal voltage Vsig may be supplied from an image signal processing circuit 21. In a specific but non-limiting example, the horizontal selector 31 may supply the signal voltage Vsig to the pixel 11 that is selected by the write scanner 32, via corresponding one of the signal lines DTL. The signal voltage Vsig may be a voltage value that corresponds to the image signal Din.

The write scanner 32 may scan the plurality of pixels 11 for each predetermined unit. In a specific but non-limiting example, the write scanner 32 may sequentially output a selection pulse to each of the scanning lines WSL in a 1-frame period. The write scanner 32 may select, in accordance with a predetermined sequence, the plurality of scanning lines WSL in response to (in synchronization with) an input of a control signal, for example, to thereby cause writing of the signal voltage Vsig and light emission to be executed in a desired order. The writing of the signal voltage Vsig (signal writing) means operation of writing the signal voltage Vsig to the gate of the driving transistor Tr2 through the write transistor Tr1 and the storage capacitor Cs2.

The write scanner 32 may be able to output two types of voltages (i.e., Von and Voff). In a specific but non-limiting example, the write scanner 32 may supply the two types of voltages (Von and Voff) to a pixel 11 to be driven via corresponding one of the scanning lines WSL, to thereby perform an ON-OFF control of the write transistor Tr1. The ON voltage Von may be equal to or higher than an ON voltage of the write transistor Tr1. The ON voltage Von may be a peak value of a selection pulse that is outputted from the write scanner 32 in a period such as a "writing period" described later. The OFF voltage Voff may be lower than the ON voltage of the write transistor Tr1, and may be lower than the ON voltage Von.

The drive scanner 33 may sequentially select the plurality of power control lines DSL for each predetermined unit in response to (in synchronization with) an input of a control signal, for example. The drive scanner 33 may be able to output two types of voltages (i.e., Von and Voff), for example. In a specific but non-limiting example, the drive scanner 33 may supply the two types of voltages (Von and Voff) to each of the pixels 11 via corresponding one of the power control lines DSL. The ON voltage Von may be equal to or higher than the ON voltage of the switching transistor Tr3. The ON voltage Von may be a peak value of a voltage that is outputted from the drive scanner 33 in a "light emission period" described later. The OFF voltage Voff may be lower than the ON voltage of the switching transistor Tr3.

The control scanner 34A may sequentially select the plurality of control lines CTL1 and CTL3 for each predetermined unit in response to (in synchronization with) an input of a control signal, for example. The control scanner 34A may be able to output two types of voltages (Von and Voff), for example. In a specific but non-limiting example, the control scanner 34A may supply the two types of voltages (Von and Voff) to each of the pixels 11 via corresponding one of the control lines CTL1 and CTL3. The ON voltage Von may be equal to or higher than the ON voltages of the switching transistors Tr4 and Tr6. The OFF voltage Voff may be lower than the ON voltages of the switching transistors Tr4 and Tr6.

The control scanner 34B may sequentially select the plurality of control lines CTL2 for each predetermined unit in response to (in synchronization with) an input of a control signal, for example. The control scanner 34B may be able to output two types of voltages (Von and Voff), for example. In a specific but non-limiting example, the control scanner 34B may supply the two types of voltages (Von and Voff) to each of the pixels 11 via corresponding one of the control lines CTL2. The ON voltage Von may be equal to or higher than the ON voltage of the switching transistor Tr5. The OFF voltage Voff may be lower than the ON voltage of the switching transistor Tr5.

Controller 20

A description will be given next of the controller 20. The controller 20 may include, for example, the image signal processing circuit 21, a timing generation circuit 22, and an electric power supply circuit 23. The image signal processing circuit 21 may perform a predetermined correction to a digital image signal Din supplied from the outside, for example, and may generate the signal voltage Vsig on the basis of the image signal obtained by the predetermined correction. The image signal processing circuit 21 may output the generated signal voltage Vsig to the horizontal selector 31, for example. Non-limiting examples of the predetermined correction may include gamma correction and overdrive correction. The timing generation circuit 22 may control circuits in the driver 30 to operate in conjunction with one another. The timing generation circuit 22 may output a control signal to each of the circuits in the driver 30 in response to (in synchronization with) a synchronizing signal Tin supplied from the outside. The electric power supply circuit 23 may generate various fixed voltages necessary for various circuits, and may supply the generated various fixed voltages. Non-limiting examples of the various circuits may include the horizontal selector 31, the write scanner 32, the drive scanner 33, the control scanners 34A and 34B, the image signal processing circuit 21, and the timing generation circuit 22.

Operation

A description is given next of operation (operation from light extinction to light emission) of the display unit 1 according to the present example embodiment. The present example embodiment may incorporate compensation operation for variation in I-V characteristics of the organic EL device 13, in order to keep luminance of the organic EL device 13 constant without being affected by a possible temporal change in the I-V characteristics of the organic EL device 13. Further, the present example embodiment may incorporate correction operation for variation in the threshold voltage, in order to keep the luminance of the organic EL device 13 constant without being affected by a possible temporal change in the threshold voltage of the driving transistor Tr2.

Figure 3:
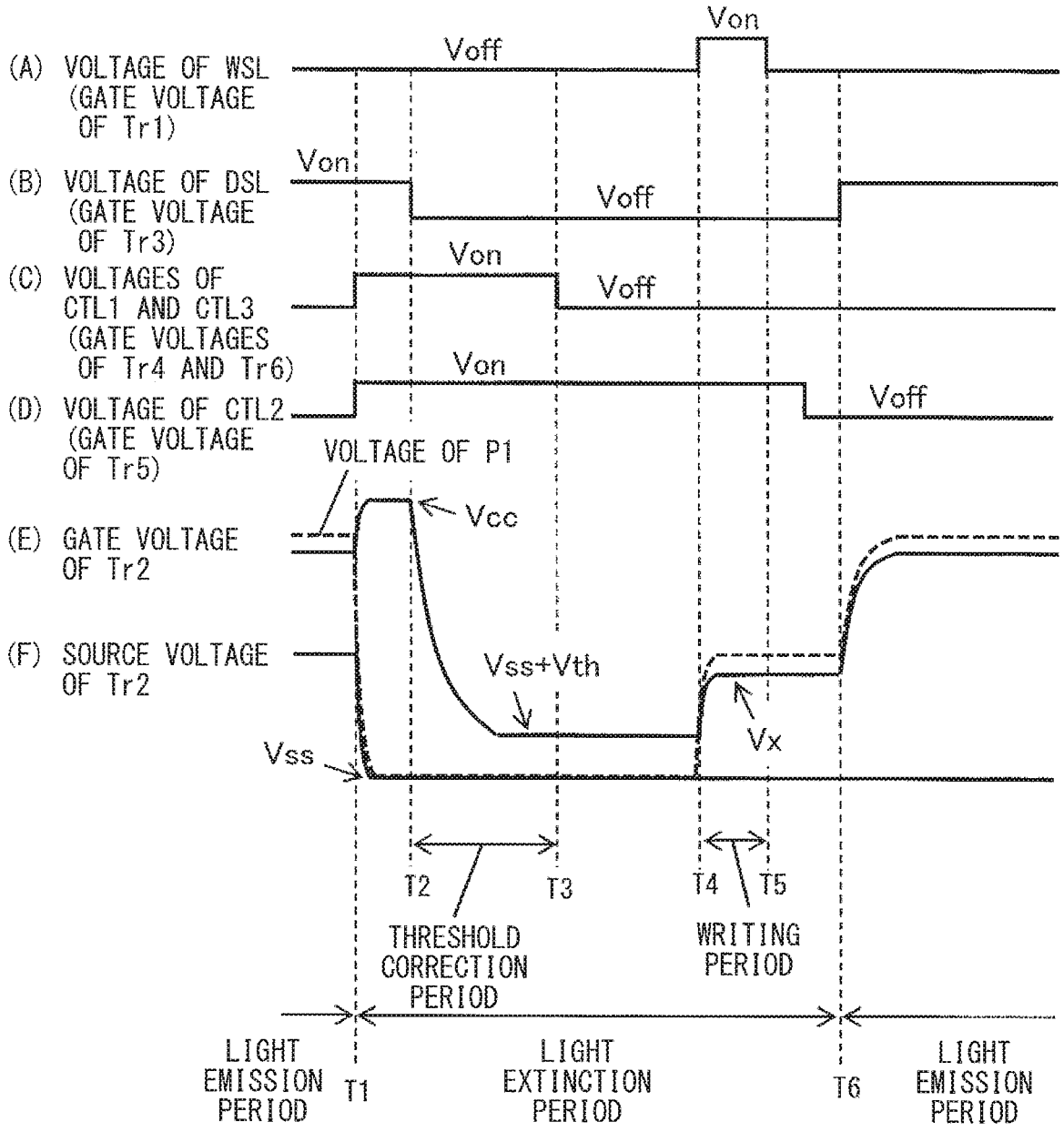
FIG. 3 illustrates an example of a temporal change in each of voltages to be applied to a scanning line and various control lines, and a gate voltage and a source voltage of a driving transistor, when focusing on one pixel.

FIG. 3 illustrates an example of a temporal change in each of voltages to be applied to the scanning line WSL, the electric power supply line DSL, and the various control lines CTL1, CTL2, and CTL3, and the gate voltage Vg and the source voltage Vs of the driving transistor Tr2, when focusing on one pixel 11. FIGS. 4 to 7 each illustrate an example of operation of the pixel 11.

Figure 4:
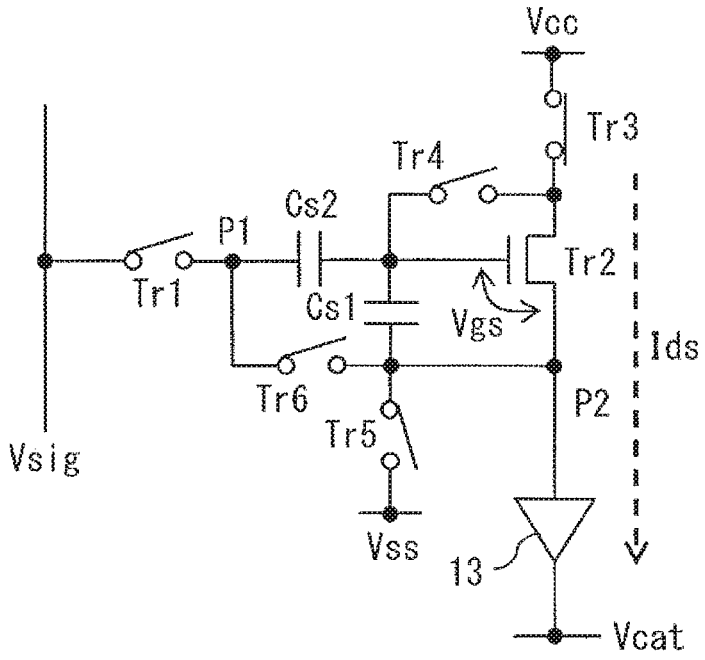
FIG. 4 illustrates an example of operation of a pixel.
Figure 5:
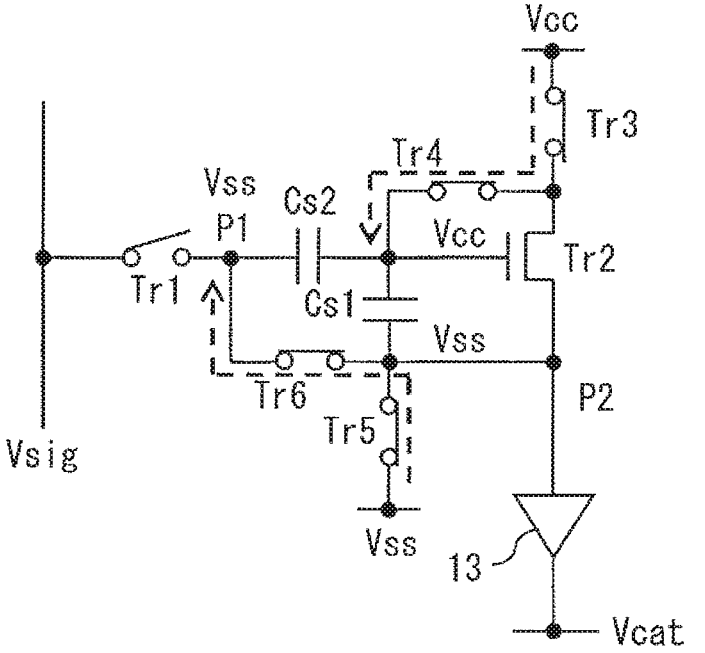
FIG. 5 illustrates an example of operation of a pixel.

First, the controller 20 and the driver 30 may prepare a threshold correction that causes a gate-source voltage Vgs of the driving transistor Tr2 to come close to the threshold voltage Vth of the driving transistor Tr2. The threshold correction may refer to correction operation that causes the gate-source voltage Vgs of the driving transistor Tr2 to come close to a threshold voltage of the driving transistor Tr2. The organic EL device 13 may emit light before preparing the threshold correction. At this occasion, the scanning line WSL may have the voltage Voff, the control lines CTL1, CTL2, and CTL3 may each have the voltage Voff, and the electric power supply line DSL may have the voltage Von, as illustrated in FIG. 4. Note that the driving transistor Tr2 may operate in a saturation region. Therefore, the current Ids that flows in the organic EL device 13 may have a value that corresponds to the level of the gate-source voltage Vgs of the driving transistor Tr2.

The controller 20 and the driver 30 may extinguish light of the organic EL device 13 upon starting to prepare the threshold correction. In a specific but non-limiting example, the controller 20 and the driver 30 may cause each of the switching transistors Tr4, Tr5, and Tr6 to turn ON (time T1, FIG. 5). At this occasion, the gate of the driving transistor Tr2 may be charged to have the voltage Vcc, and the terminal P2 of the driving transistor Tr2 and the terminal P1 of the write transistor Tr1 may be both charged to have the voltage Vss. When the voltage Vss that is charged to the terminal P2 of the driving transistor Tr2 is lower than the sum of the threshold Vthel and the cathode voltage Vcat of the organic EL device 13 (i.e., Vss<Vthel+Vcat), the light of the organic EL device 13 may be extinguished. Further, it is necessary to set the difference between the voltage Vcc and the voltage Vss to be equal to or higher than the threshold voltage Vth of the driving transistor Tr2 in order to properly perform threshold correction operation.

Figure 6:
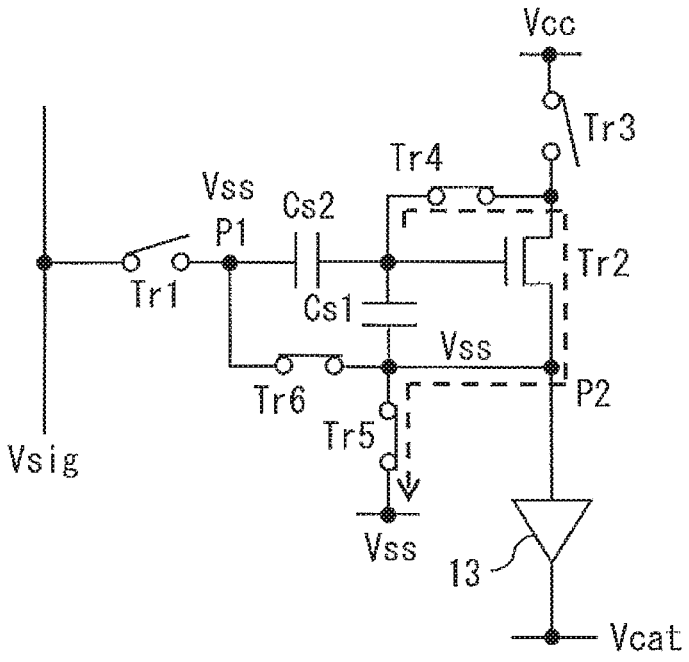
FIG. 6 illustrates an example of operation of a pixel.

Next, the controller 20 and the driver 30 may cause the switching transistor Tr3 to turn OFF in the threshold correction operation (time T3). When the switching transistor Tr3 is turned OFF, a current may flow as illustrated in FIG. 6, and thereby the gate voltage of the driving transistor Tr2 is reduced. After a lapse of a certain period of time, the gate voltage Vss of the driving transistor Tr2 may become a voltage Vss+Vth which is the sum of the voltage Vss and the threshold voltage of the driving transistor Tr2. The threshold voltage Vth of the driving transistor Tr2 may be stored in each of the storage capacitors Cs1 and Cs2. Thereafter, the switching transistors Tr4 and Tr6 may be turned OFF (time T3). Accordingly, the controller 20 and the driver 30 performs the threshold correction operation by turning ON and OFF the switching transistors Tr6 and Tr4 while the switching transistor Tr5 is turned ON and the write transistor Tr1 is turned OFF.

Figure 7:
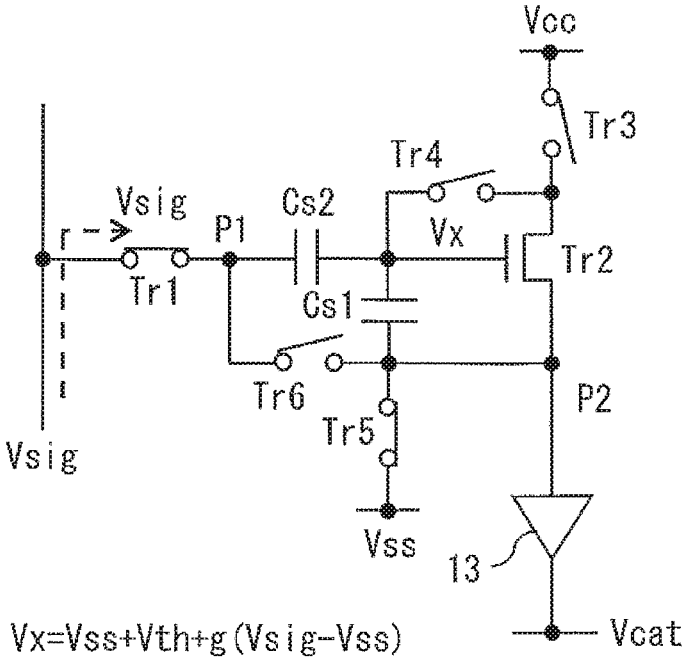
FIG. 7 illustrates an example of operation of a pixel.

Next, in the writing period, the controller 20 and the driver 30 may turn ON the write transistor Tr1 and may write the signal voltage Vsig to the terminal P1 of the write transistor Tr1 (time T4, FIG. 7). At this occasion, an electric potential change of the terminal P1 of the write transistor Tr1 may be inputted to the gate of the driving transistor Tr2 through the storage capacitor Cs2. In other words, after performing the threshold correction operation, the controller 20 and the driver 30 may turn ON the write transistor Tr1 to thereby apply a voltage corresponding to the signal voltage Vsig to the gate of the write transistor Tr1. This resultantly allows the gate voltage of the driving transistor Tr2 to become a voltage Vx as illustrated in FIG. 7. The voltage Vx may include the threshold voltage Vth of the driving transistor Tr2. Therefore, the gate-source voltage Vgs of the driving transistor Tr2 may correspond to the threshold voltage of the driving transistor Tr2. The controller 20 and the driver 30 may turn OFF the write transistor Tr1 upon the end of the signal writing (time T5). At the end, in the light emission period, the controller 20 and the driver 30 may turn OFF the switching transistor Tr5 and may turn ON the switching transistor Tr3 (time T6, FIG. 4). When the switching transistor Tr3 is turned ON, a current may flow from the electric power supply circuit 23, and the organic EL device 13 may emit light.

Example Effects

A description will be given next of an effect derived from the display unit 1 according to the present example embodiment.

In the present example embodiment, the six transistors and the two storage capacitors may be provided. The six transistors may include the driving transistor Tr2, the write transistor Tr1, the four switching transistors Tr3, Tr4, Tr5, and Tr6. The two storage capacitors may include the storage capacitors Cs1 and Cs2. This configuration makes it possible to at least suppress fluctuations of a source potential of the driving transistor Tr2 upon writing the signal voltage Vsig to the gate of the driving transistor Tr2. This resultantly makes it possible to reduce the irregular luminance.

In the present example embodiment, the gate-source voltage Vgs of the driving transistor Tr2 is corrected by the threshold correction operation that is performed prior to the signal writing. This makes it possible to correct the fluctuations of the current that flows in the organic EL device 13. Further, the source voltage of the driving transistor Tr2 becomes the voltage Vss through the switching transistor Tr5 upon the signal writing. Therefore, the gate-source voltage Vgs of the driving transistor Tr2 is unchanged without being affected by the fluctuations of the cathode potential. This resultantly makes it possible to obtain uniform image quality without nonuniformity or crosstalk.

2. Second Example Embodiment

Configuration

Figure 8:
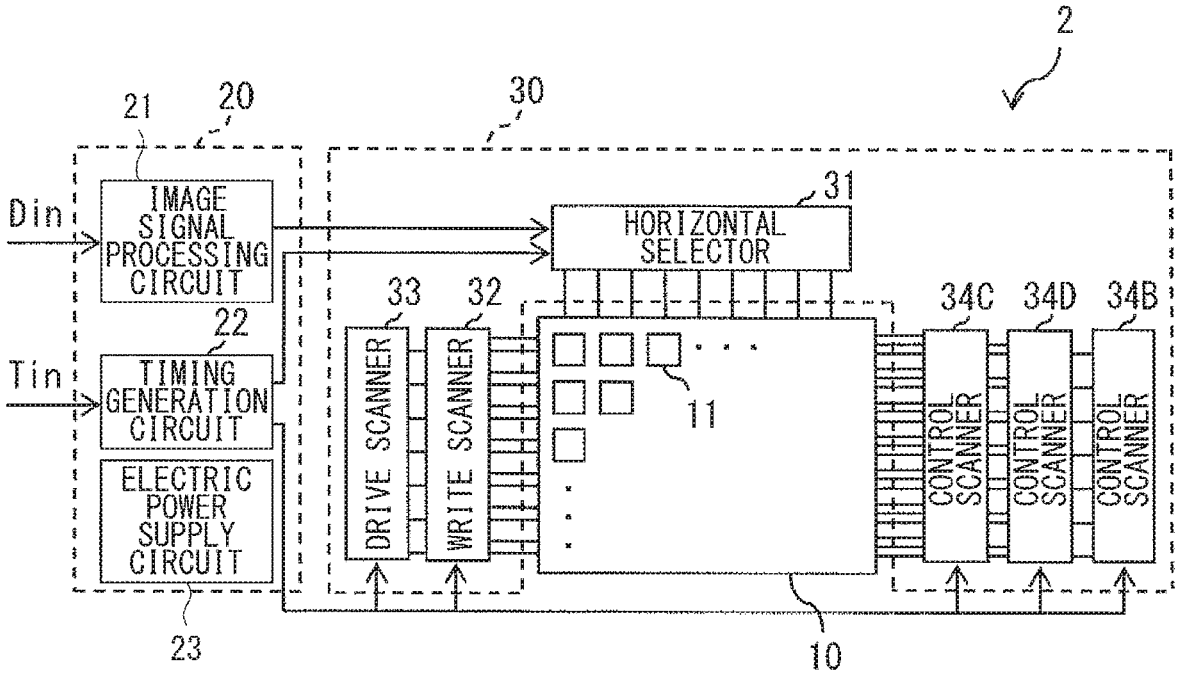
FIG. 8 is a schematic configuration diagram of a display unit according to one embodiment of the disclosure.

FIG. 8 illustrates a schematic configuration of a display unit 2 according to an embodiment of the disclosure. The display unit 2 may correspond to a display unit in which control scanners 34C and 34D are provided in place of the control scanner 34A in the display unit 1 according to the above-described example embodiment.

In the present example embodiment, each of the control lines CTL1 may be coupled to both an unillustrated output end of the control scanner 34C and the gate of the switching transistor Tr4. Each of the control lines CTL2 may be coupled to both an unillustrated output end of the control scanner 34B and the gate of the switching transistor Tr5. Each of the control lines CTL3 may be coupled to both an unillustrated output end of the control scanner 34D and the gate of the switching transistor Tr6.

The control scanner 34C may sequentially select the plurality of control lines CTL1 for each predetermined unit in response to (in synchronization with) an input of a control signal, for example. The control scanner 34C may be able to output two types of voltages (Von and Voff). In a specific but non-limiting example, the control scanner 34C may supply the two types of voltages (Von and Voff) to each of the pixels 11 via corresponding one of the control lines CTL1. The ON voltage Von may be equal to or higher than the ON voltage of the switching transistor Tr4. The OFF voltage Voff may be lower than the ON voltage of the switching transistor Tr4.

The control scanner 34D may sequentially select the plurality of control lines CTL3 for each predetermined unit in response to (in synchronization with) an input of a control signal, for example. The control scanner 34D may be able to output two types of voltages (Von and Voff). In a specific but non-limiting example, the control scanner 34D may supply the two types of voltages (Von and Voff) to each of the pixels 11 via corresponding one of the control lines CTL3. The ON voltage Von may be equal to or higher than the ON voltage of the switching transistor Tr6. The OFF voltage Voff may be lower than the ON voltage of the switching transistor Tr6.

Operation

A description is given next of operation (operation from the light extinction to light emission) of the display unit 2 according to the present example embodiment.

Figure 9:
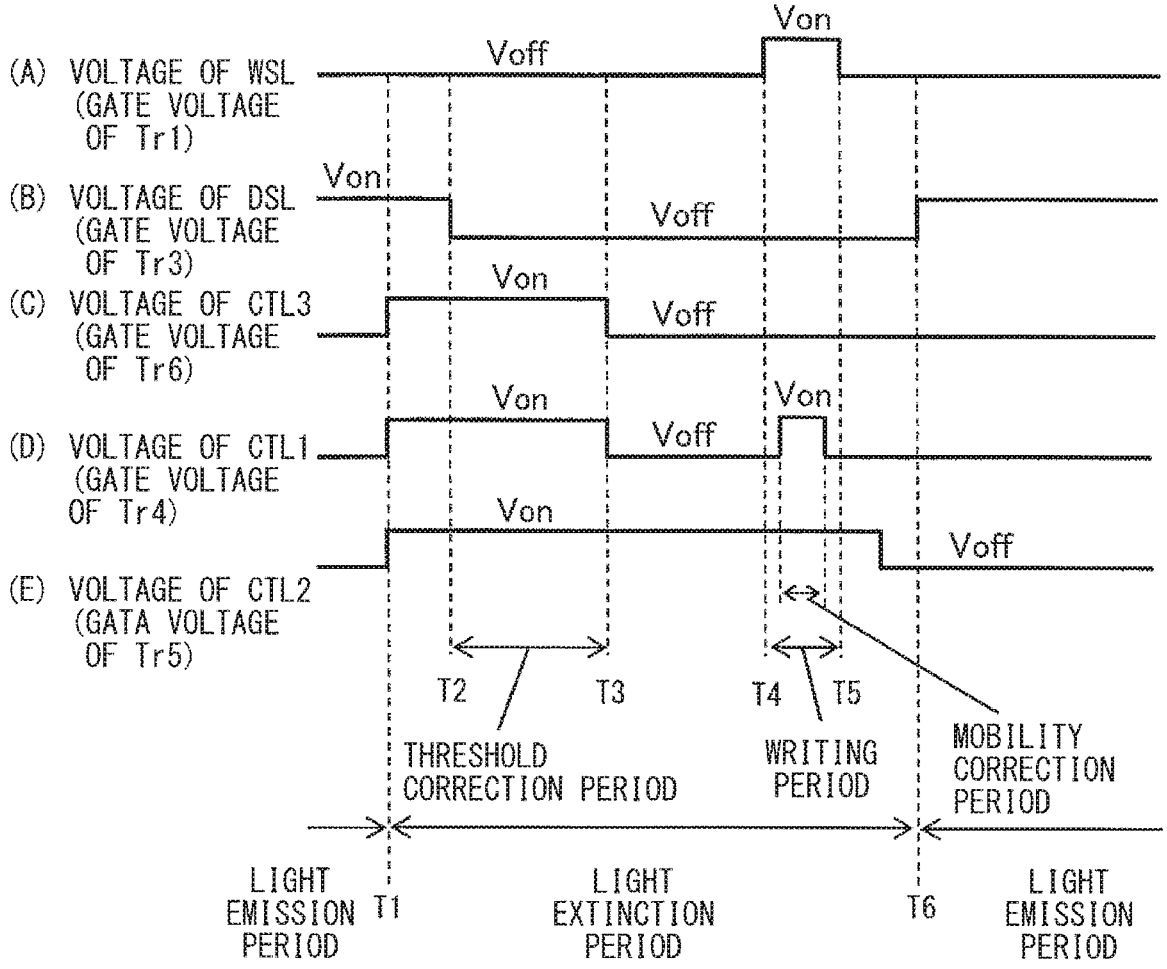
FIG. 9 illustrates an example of a temporal change in each of voltages to be applied to a scanning line and various control lines, when focusing on one pixel.
Figure 10:
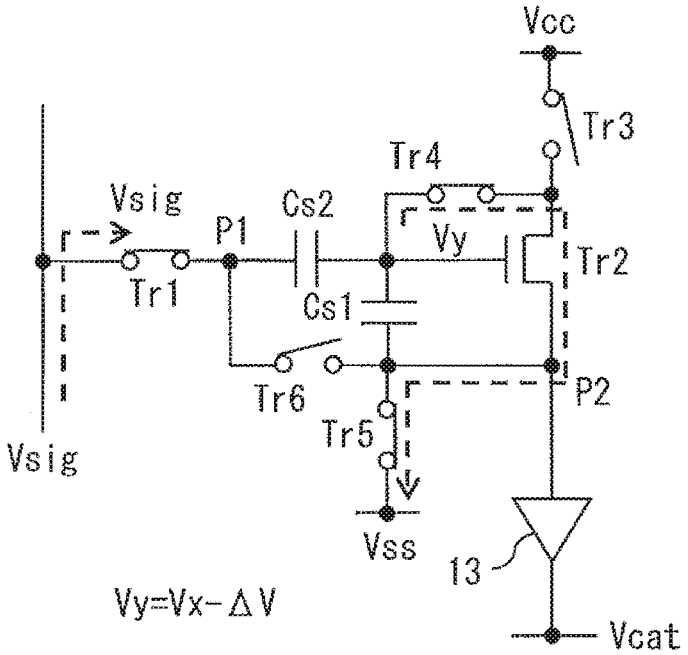
FIG. 10 illustrates an example of operation of a pixel.

FIG. 9 illustrates an example of a temporal change in each of voltages to be applied to the scanning line WSL, the electric power supply line DSL, and the various control lines CTL1, CTL2, and CTL3, when focusing on one pixel 11. FIG. 10 illustrates an example of operation of the pixel 11. In the present example embodiment, the write transistor Tr1 and the switching transistor Tr4 may be both turned ON at the same time upon writing. This may correspond to a portion within time T4 to time T5 of FIG. 9.

Example Effects

A description is given of an effect derived from a case in which the write transistor Tr1 and the switching transistor Tr4 are turned ON at the same time upon the signal writing.

In the present example embodiment, the six transistors and the two storage capacitors may be provided. The six transistors may include the driving transistor Tr2, the write transistor Tr1, the four switching transistors Tr3, Tr4, Tr5, and Tr6. The two storage capacitors may include the storage capacitors Cs1 and Cs2. This configuration makes it possible to at least suppress fluctuations of a source potential of the driving transistor Tr2 upon writing the signal voltage Vsig to the gate of the driving transistor Tr2. This resultantly makes it possible to reduce the irregular luminance.

Further, in the present example embodiment, the threshold correction operation of the driving transistor Tr2 is performed prior to the signal writing, as described above. This causes the gate voltage of the driving transistor Tr2 to become the voltage Vx before the switching transistor Tr4 is turned ON upon writing. When the switching transistor Tr4 is turned ON in this state, a current flows as illustrated in FIG. 10. At this occasion, the gate-source voltage Vgs of the driving transistor Tr2 is corrected. Therefore, the current that flows in the driving transistor Tr2 reflect mobility of the driving transistor Tr2. In other words, a large current flows in the driving transistor Tr2 when the mobility of the driving transistor Tr2 is high, whereas a small current flows in the driving transistor Tr2 when the mobility of the driving is low. Accordingly, the gate voltage of the driving transistor Tr2 is reduced in accordance with the value of the mobility. After a lapse of a certain period of time, turning OFF the switching transistor Tr4 when the gate voltage of the driving transistor Tr2 becomes a voltage Vy allows the gate-source voltage Vgs of the driving transistor Tr2 to become a value that reflects the mobility. This makes it possible not only to perform the threshold correction but also to perform mobility correction to the driving transistor Tr2. The mobility correction means operation of correcting a voltage stored between the gate and the source of the driving transistor Tr2 (i.e., the gate-source voltage Vgs) in accordance with the level of the mobility of the driving transistor Tr2.

3. Third Example Embodiment

Configuration

Figure 11:
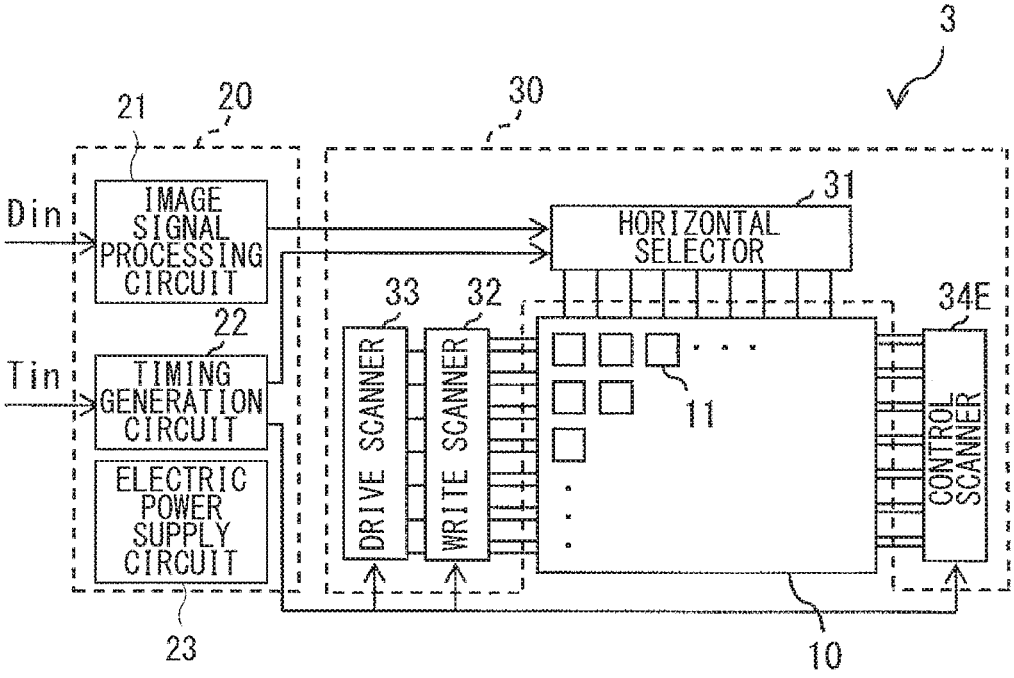
FIG. 11 is a schematic configuration diagram of a display unit according to one embodiment of the disclosure.
Figure 12:
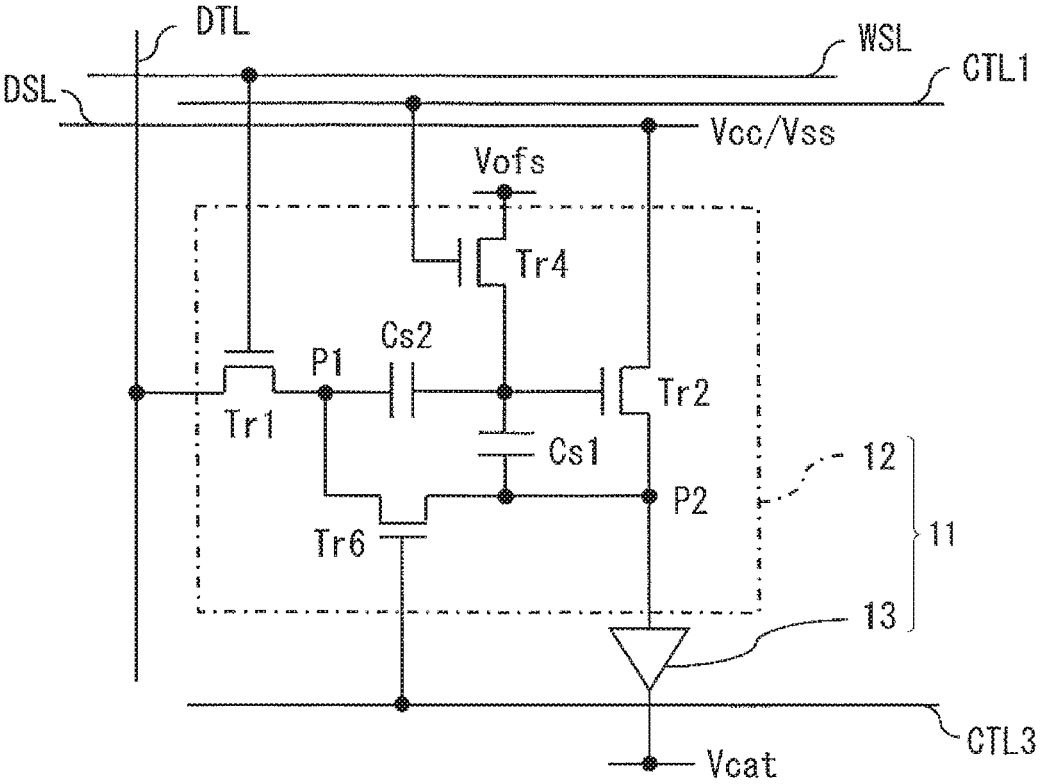
FIG. 12 illustrates an example of a circuit configuration of each of pixels illustrated in FIG. 11.

FIG. 11 illustrates a schematic configuration of a display unit 3 according to an embodiment of the disclosure. The display unit 3 may correspond to a display unit in which a control scanner 34E is provided in place of the control scanners 34A and 34B, and each of the pixel circuits 12 is configured as illustrated in FIG. 12, in the display unit 1 according to the above-described example embodiment.

In the present example embodiment, each of the control lines CTL1 and CTL3 may be coupled to an unillustrated output end of the control scanner 34E. In the present example embodiment, each of the pixel circuits 12 may include, for example, the write transistor Tr1, the driving transistor Tr2, the switching transistors Tr4 and Tr6, and the storage capacitors Cs1 and Cs2.

The write transistor Tr1 may control application of the signal voltage Vsig to the gate of driving transistor Tr2. The signal voltage Vsig may correspond to the image signal Din. In a specific but non-limiting example, the write transistor Tr1 may sample a voltage of the signal line DTL. The write transistor Tr1 may also write the voltage obtained by the sampling into the gate of the driving transistor Tr2 through the storage capacitor Cs2. The driving transistor Tr2 may be coupled in series to the organic EL device 13. The driving transistor Tr2 may drive the organic EL device 13. The driving transistor Tr2 may control a current that flows in the organic EL device 13 in accordance with the level of the voltage sampled by the write transistor Tr1.

The storage capacitor Cs1 may store a predetermined voltage between the gate and the source of the driving transistor Tr2. The storage capacitor Cs2 may store a predetermined voltage between the terminal P1 of the write transistor Tr1 and the gate of the driving transistor Tr2. The terminal P1 of the write transistor Tr1 may be adjacent to the driving transistor Tr2. The storage capacitor Cs1 may be provided at an electrically conductive path between the gate of the driving transistor Tr2 and the anode of the organic EL device 13. In other words, the storage capacitor Cs1 may be provided at the electrically conductive path between the gate of the driving transistor Tr2 and the terminal P2 of the driving transistor Tr2. The terminal P2 of the driving transistor Tr2 may be adjacent to the organic EL device 13. The storage capacitor Cs2 may be provided at an electrically conductive path between the terminal P1 of the write transistor Tr1 and the gate of the driving transistor Tr2.

The capacity of the storage capacitor Cs1 and the capacity of the storage capacitor Cs2 may be equal to each other, for example. The switching transistor Tr4 controls the gate voltage Vg of the driving transistor Tr2 upon correction operation that allows a gate-source voltage of the driving transistor Tr2 to come close to the threshold voltage Vth of the driving transistor Tr2. The switching transistor Tr4 may be provided at an electrically conductive path between the gate of the driving transistor Tr2 and a fixed voltage line Vofs. The switching transistor Tr6 may be provided at an electrically conductive path between the terminal P2 of the driving transistor Tr2 and the terminal P1 of the write transistor Tr1. The terminal P2 of the driving transistor Tr2 may be adjacent to the organic EL device 13. The terminal P1 of the write transistor Tr1 may be adjacent to the driving transistor Tr2.

Each of the signal lines DTL may be coupled to an unillustrated output end of the horizontal selector 31 and to one of the source or the drain of the write transistor Tr1. Each of the scanning lines WSL may be coupled to an unillustrated output end of the write scanner 32 and to the gate of the write transistor Tr1. Each of the power control lines DSL may be coupled to an unillustrated output end of a drive scanner 33 and to one of the source or the drain of the driving transistor Tr2 (i.e., a terminal different from the terminal P2).

Each of the control lines CTL1 may be coupled to an unillustrated output end of the control scanner 34E and to the gate of the switching transistor Tr4. Each of the control lines CTL3 may be coupled to an unillustrated output end of the control scanner 34E and to the gate of the switching transistor 6.

The write transistor Tr1 may control application of the signal voltage Vsig to the gate of the driving transistor Tr2. The signal Vsig may correspond to the image signal Din. The gate of the write transistor Tr1 may be coupled to the scanning line WSL. One of the source or the drain of the write transistor Tr1 may be coupled to the signal line DTL. The other (i.e., the terminal P1), of the source and the drain of the write transistor Tr1, that is not coupled to the signal line DTL may be coupled to the storage capacitor Cs2. The driving transistor Tr2 may control a current that flows in the organic EL device 13. The gate of the driving transistor Tr2 may be coupled to the storage capacitor Cs2. One of the source or the drain of the driving transistor Tr2 may be coupled to the power control line DSL. The other (i.e., the terminal P2), of the source and the drain of the driving transistor Tr2, that is not coupled to the power control line DSL may be coupled to the anode of the organic EL device 13.

The switching transistor Tr4 controls the gate voltage Vg of the driving transistor Tr2 upon correction operation that allows a gate-source voltage of the driving transistor Tr2 to come close to the threshold voltage Vth of the driving transistor Tr2. The gate of the switching transistor Tr4 may be coupled to the control line CTL1. One of the source or the drain of the switching transistor Tr4 may be coupled to the fixed voltage line Vofs. The other of the source and the drain of the switching transistor Tr4, that is not coupled to the fixed voltage line Vofs may be coupled to the gate of the driving transistor Tr2. The switching transistor Tr6 may be provided at an electrically conductive path between the terminal P2 of the driving transistor Tr2 and the terminal P1 of the write transistor Tr1. The terminal P2 of the driving transistor Tr2 may be adjacent to the organic EL device 13. The terminal P1 of the write transistor Tr1 may be adjacent to the organic EL device 13. The gate of the switching transistor Tr6 may be coupled to the control line CTL3. One of the source or the drain of the switching transistor Tr6 may be coupled to one of the source or the drain of the write transistor Tr1 (i.e., the terminal P1). The other of the source and the drain of the switching transistor Tr6, that is not coupled to the terminal P1 may be coupled to one of the source or the drain of the driving transistor Tr2 (i.e., the terminal P2).

The storage capacitor Cs1 may be provided at an electrically conductive path between the gate of the driving transistor Tr2 and the anode of the organic EL device 13. In other words, the storage capacitor Cs1 may be provided at the electrically conductive path between the gate of the driving transistor Tr2 and the terminal P2 of the driving transistor Tr2. The terminal P2 of the driving transistor Tr2 may be adjacent to the organic EL device 13. The storage capacitor Cs1 may include one end that is coupled to the gate of the driving transistor Tr2. The storage capacitor Cs1 may include the other end that is coupled to one of the source or the drain of the driving transistor Tr2 (i.e., the terminal P2). The storage capacitor Cs2 may be provided at an electrically conductive path between the terminal P1 of the write transistor Tr1 and the gate of the driving transistor Tr2. The terminal P1 of the write transistor Tr1 may be adjacent to the driving transistor Tr2. The storage capacitor Cs2 may include one end that is coupled to one of the source or the drain of the write transistor Tr1 (i.e., the terminal P1). The storage capacitor Cs2 may include the other end that is coupled to the gate of the driving transistor Tr2. The anode of the organic EL device 13 may be coupled to one of the source or the drain of the driving transistor Tr2 (i.e., the terminal P2). The organic EL device 13 may include a cathode that is coupled to a cathode voltage line Vcat.

The driver may include, for example, the horizontal selector 31, the write scanner 32, the drive scanner 33, and the control scanner 34E.

The drive scanner 33 may sequentially select the plurality of power control lines DSL for each predetermined unit in response to (in synchronization with) an input of a control signal, for example. The drive scanner 33 may be able to output two types of voltages (i.e., Vcc and Vss), for example. In a specific but non-limiting example, the drive scanner 33 may supply the two types of voltages (Vcc and Vss) to each of the pixels 11 via corresponding one of the power control lines DSL. The fixed voltage Vss may be lower than a voltage that is the sum of the threshold voltage Vthel of the organic EL device 13 and the cathode voltage Vcat of the organic EL device 13 (i.e., Vthel+Vcat). The fixed voltage Vcc may be higher than the voltage (Vthel+Vcat).

The control scanner 34E may sequentially select the plurality of control lines CTL1 and CTL3 for each predetermined unit in response to (in synchronization with) an input of a control signal, for example. The control scanner 34E may be able to output two types of voltages (Von and Voff), for example. In a specific but non-limiting example, the control scanner 34E may supply the two types of voltages (Von and Voff) to each of the pixels 11 via corresponding one of the control lines CTL1 and CTL3. The ON voltage Von may be equal to or higher than the ON voltages of the switching transistors Tr4 and Tr6. The OFF voltage Voff may be lower than the ON voltages of the switching transistors Tr4 and Tr6.

Operation

A description is given next of operation (operation from light extinction to light emission) of the display unit 3 according to the present example embodiment.

Figure 13:
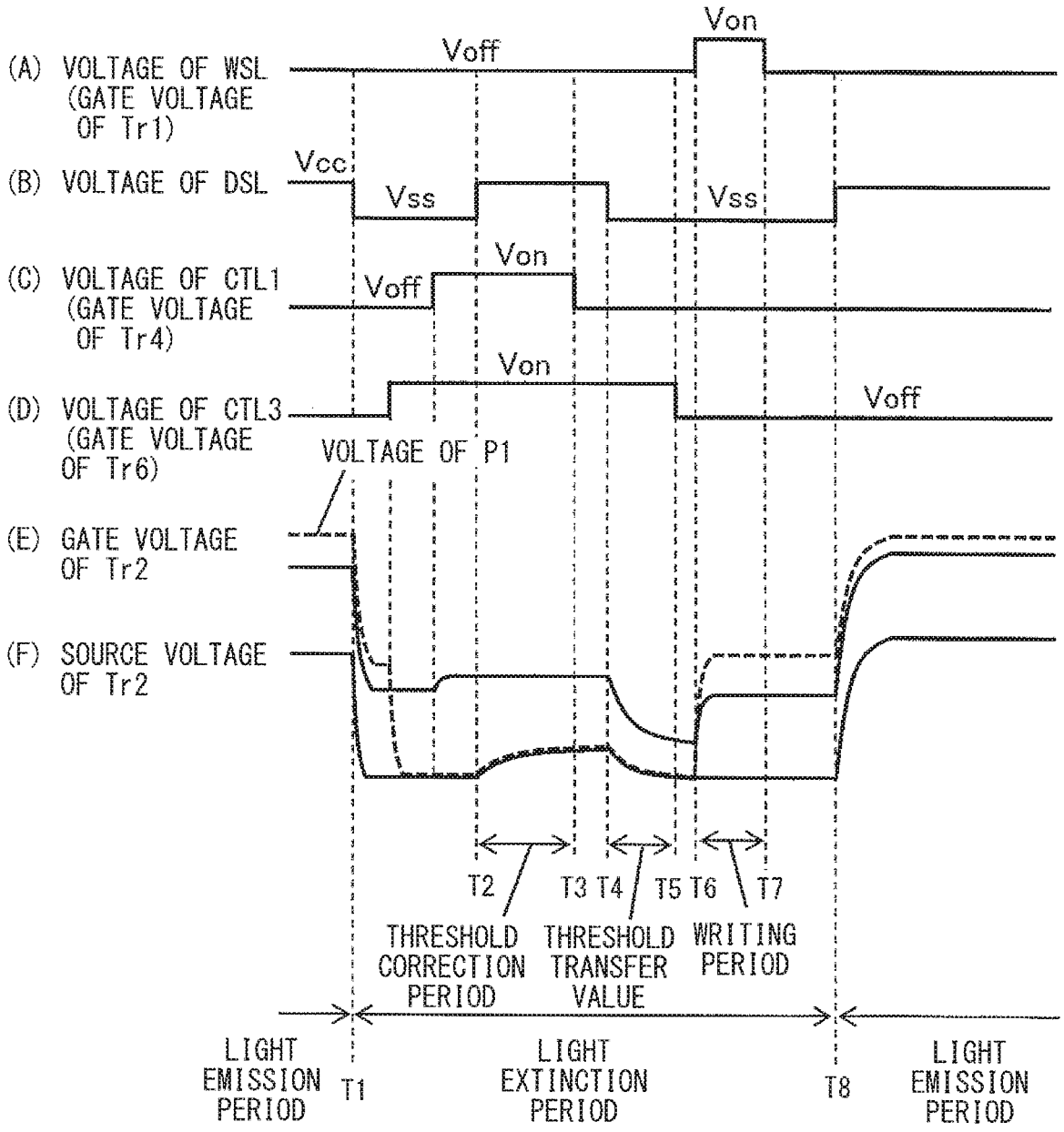
FIG. 13 illustrates an example of a temporal change in each of voltages to be applied to a scanning line and various control lines, and a gate voltage and a source voltage of a driving transistor, when focusing on one pixel.

FIG. 13 illustrates an example of a temporal change in each of voltages to be applied to the scanning line WSL, the electric power supply line DSL, and the various control lines CTL1 and CTL3, and the gate voltage Vg and the source voltage Vs of the driving transistor Tr2, when focusing on one pixel 11. FIGS. 14 to 18 each illustrate an example of operation of the pixel 11.

Figure 14:
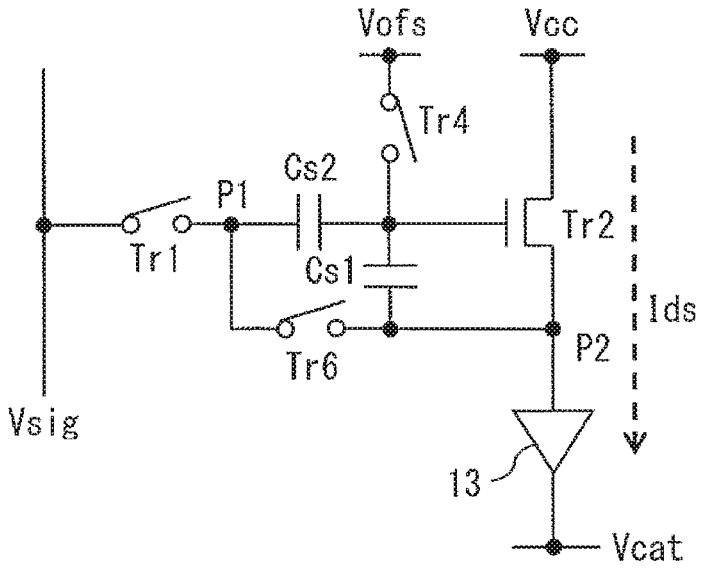
FIG. 14 illustrates an example of operation of a pixel.

First, the controller 20 and the driver 30 may prepare a threshold correction that causes the gate-source voltage Vgs of the driving transistor Tr2 to come close to the threshold voltage Vth of the driving transistor Tr2. The organic EL device 13 may emit light before preparing the threshold correction. At this occasion, the scanning line WSL may have the voltage Voff, the control lines CTL1 and CTL3 may each have the voltage Voff, and the electric power supply line DSL may have the voltage Vcc, as illustrated in FIG. 14. Note that the driving transistor Tr2 may operate in a saturation region. Therefore, the current Ids that flows in the organic EL device 13 may have a value that corresponds to the level of the gate-source voltage Vgs of the driving transistor Tr2.

Figure 15:
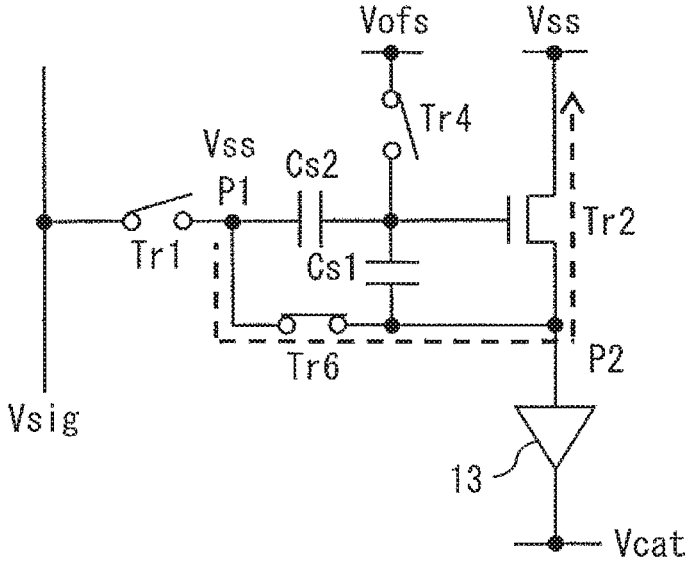
FIG. 15 illustrates an example of operation of a pixel.

The controller 20 and the driver 30 may extinguish light of the organic EL device 13 upon starting to prepare the threshold correction. In a specific but non-limiting example, the controller 20 and the driver 30 may cause the voltage of the power control line DSL to vary from the voltage Vcc to the voltage Vss (time T1) and cause the switching transistor Tr6 to turn ON (FIG. 15). At this occasion, when the voltage Vss is lower than the sum of the threshold Vthel and the cathode voltage Vcat of the organic EL device 13 (i.e., Vss<Vthel+Vcat), the light of the organic EL device 13 may be extinguished, and thereby, the terminal P2 of the driving transistor Tr2 and the terminal P1 of the write transistor Tr1 may each have the voltage Vss.

Next, the controller 20 and the driver 30 may cause the switching transistor Tr4 to turn ON and may cause the gate voltage of the driving transistor Tr2 to be set to the voltage Vofs. At this occasion, the gate-source voltage Vgs of the driving transistor Tr2 may become a voltage Vofs−Vss. The threshold correction operation may possibly be unperformable if the voltage Vofs−Vss is lower than the threshold voltage Vth of the driving transistor Tr2. Therefore, a voltage level that satisfies the condition of Vofs−Vss>Vth may be necessary in order to perform the threshold correction operation.

Figure 16:
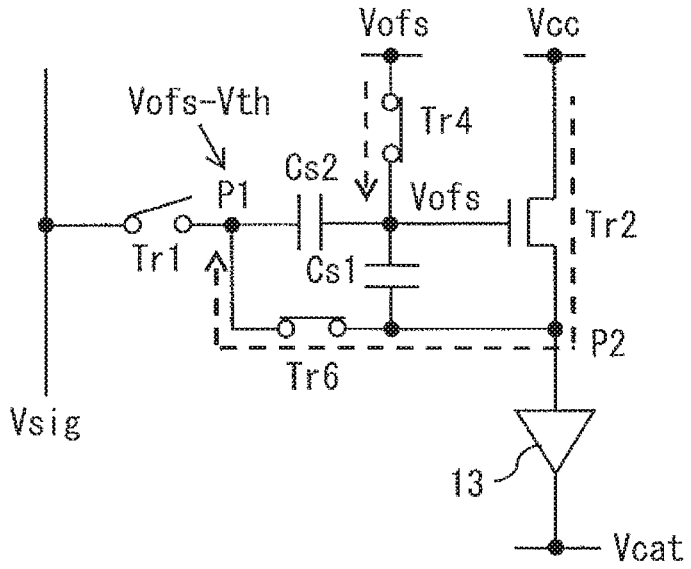
FIG. 16 illustrates an example of operation of a pixel.

Next, the controller 20 and the driver 30 may cause the voltage of the power control line DSL to vary from the voltage Vss to the voltage Vcc in the threshold correction period (time T2, FIG. 16). This may cause the anode of the organic EL device 13 to become the source of the driving transistor Tr2, and thus a current may flow as illustrated in FIG. 16. At this occasion, the current may not flow in the organic EL device 13 if an anode voltage of the organic EL device 13 is lower than the sum of the cathode voltage Vcat of the organic EL device 13 and the threshold voltage of the organic EL device 13. The threshold correction operation may be properly performed, and the source potential of the driving transistor Tr2 may increase. After a lapse of a certain period of time, a gate-source voltage of the driving transistor Tr2 of the driving transistor Tr2 may become the voltage Vth, and the voltage Vth may be stored in each of the storage capacitors Cs1 and Cs2. Thereafter, the controller 20 and the driver 30 may cause the switching transistor Tr4 to turn OFF (time T3). Accordingly, the controller 20 and the driver 30 performs the threshold correction operation by turning ON and OFF the switching transistor Tr4 and keeping a voltage that corresponds to the threshold voltage Vth of the driving transistor Tr2 in the storage capacitors Cs1 and Cs2 while the switching transistor Tr6 is turned ON and the write transistor Tr1 is turned OFF.

Figure 17:
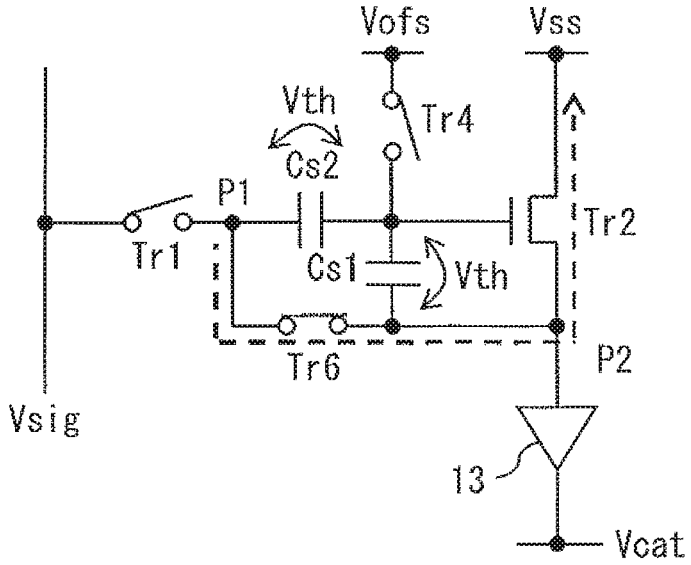
FIG. 17 illustrates an example of operation of a pixel.

Next, the controller 20 and the driver 30 may cause the voltage of the power control line DSL to vary from the voltage Vcc to the voltage Vss in a threshold transfer period (time T4, FIG. 17). This may cause the anode voltage of the organic EL device 13 to be reduced. At this occasion, the switching transistor Tr4 may be in an OFF state. Therefore, the gate voltage of the driving transistor Tr2 may be reduced while the gate-source voltage Vgs of the driving transistor Tr2 is kept, by means of the storage capacitors Cs1 and Cs2, at the voltage level of the threshold voltage Vth of the driving transistor Tr2. After a lapse of a certain period of time, the switching transistor Tr6 may be turned OFF (time T5).

Figure 18:
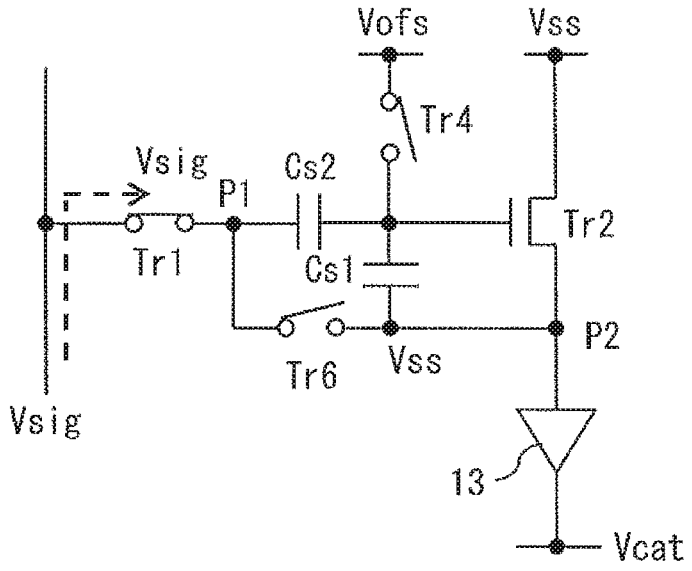
FIG. 18 illustrates an example of operation of a pixel.

Next, in the writing period, the controller 20 and the driver 30 may turn ON the write transistor Tr1 and may write the signal voltage Vsig to the terminal P1 of the write transistor Tr1 (time T6, FIG. 18). At this occasion, an electric potential change of the terminal P1 of the write transistor Tr1 may be inputted to the gate of the driving transistor Tr2 through the storage capacitor Cs2. In other words, after performing the threshold correction operation, the controller 20 and the driver 30 may turn ON the write transistor Tr1 to thereby apply a voltage corresponding to the signal voltage Vsig to the gate of the write transistor Tr1. The gate-source voltage Vgs of the driving transistor Tr2 may include the threshold voltage Vth of the driving transistor Tr2. Therefore, the gate-source voltage Vgs of the driving transistor Tr2 may correspond to the threshold voltage Vth of the driving transistor Tr2. Thereafter, the controller 20 and the driver 30 may turn OFF the write transistor Tr1 upon the end of the signal writing (time T7). At the end, in the light emission period, the controller 20 and the driver 30 may cause the voltage of the power control line DSL to vary from the voltage Vss to the voltage Vcc (time T8). This allows a current to flow from the power control line DSL, and the organic EL device 13 to emit light (FIG. 14).

Example Effects

In the present example embodiment, the four transistors and the two storage capacitors may be provided. The four transistors may include the driving transistor Tr2, the write transistor Tr1, the two switching transistors Tr4 and Tr6. The two storage capacitors may include the storage capacitors Cs1 and Cs2. This configuration makes it possible to at least suppress fluctuations of a source potential of the driving transistor Tr2 upon writing the signal voltage Vsig to the gate of the driving transistor Tr2. This resultantly makes it possible to reduce the irregular luminance.

Further, in the present example embodiment, the gate-source voltage Vgs of the driving transistor Tr2 is corrected by the threshold correction operation that is performed prior to the signal writing. This makes it possible to correct the fluctuations of the current that flows in the organic EL device 13. Moreover, the signal writing is performed when the power control line DSL has the voltage Vss. Therefore, the source voltage of the driving transistor Tr2 becomes the voltage Vss, and thereby, the gate-source voltage Vgs of the driving transistor Tr2 is unchanged without being affected by the fluctuations of the cathode potential. This resultantly makes it possible to obtain uniform image quality without nonuniformity or crosstalk.

4. Modification Example of Third Example Embodiment

A description is given below of a modification example of the display unit 3 according to the above-described example embodiment. Note that the same reference numerals are assigned to components common to those of the display unit 1 of the above-described example embodiment. Further, descriptions of the components common to those of the display unit 1 of the above-described example embodiment are omitted where appropriate.

Figure 19:
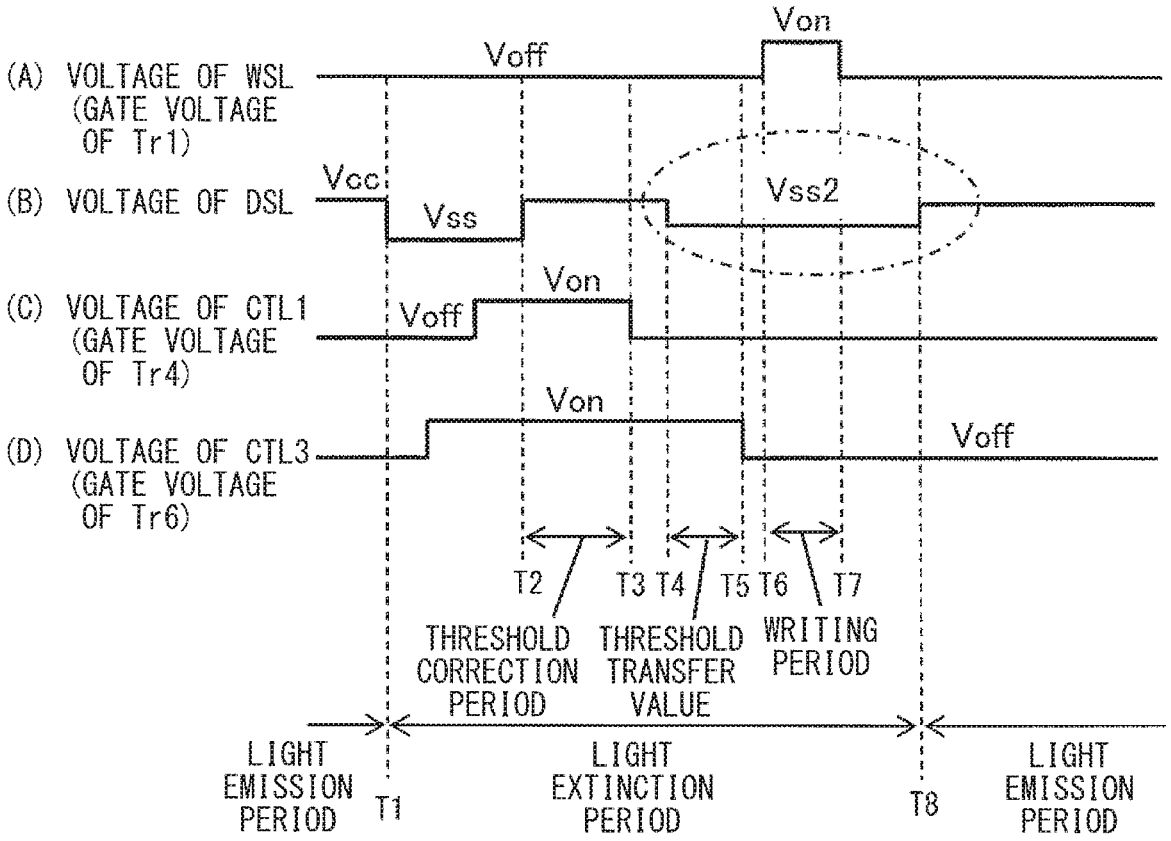
FIG. 19 illustrates a modification example of each of voltage waveforms of a scanning line and various control lines illustrated in FIG. 13.

In a specific but non-limiting example, the voltage of the power control line DSL may have a voltage value (i.e., Vss2) that is different from the voltage Vss upon the signal writing in the above-described example embodiment, as illustrated in FIG. 19. The voltage Vss2 may have a voltage value that is lower than the voltage Vofs and higher than the voltage Vss.

In the above-described example embodiment, the voltage change of the terminal P1 of the write transistor Tr1 may be inputted to the gate of the driving transistor Tr2 through the storage capacitor Cs2. In order to perform black color display, it is advantageous that the change of the gate voltage of the driving transistor Tr2 is in a negative direction. However, the voltage Vss needs to be low to a predetermined level in order to perform the threshold correction operation. Moreover, it is advantageous for the drive scanner 33 to output a voltage that is equal to or higher than a voltage of 0V. For this reason, setting the voltage Vss is difficult in the pixel circuit 12 in the above-described example embodiment. To address this, in the present modification example, the power control line DSL may have the voltage Vss upon the threshold correction operation, and the power control line DSL may further have the voltage Vss2 which is higher than the voltage Vss before the signal writing. This makes it possible to relatively easily perform voltage setting.

5. Fourth Example Embodiment

Configuration

Figure 20:
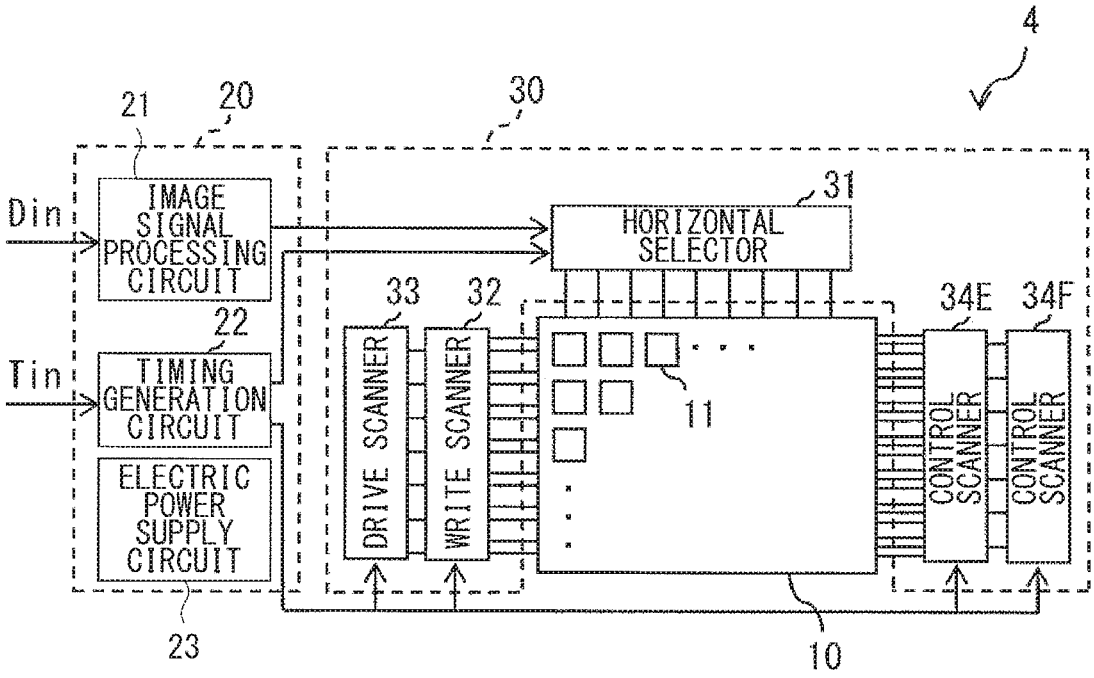
FIG. 20 is a schematic configuration diagram of a display unit according to one embodiment of the disclosure.
Figure 21:
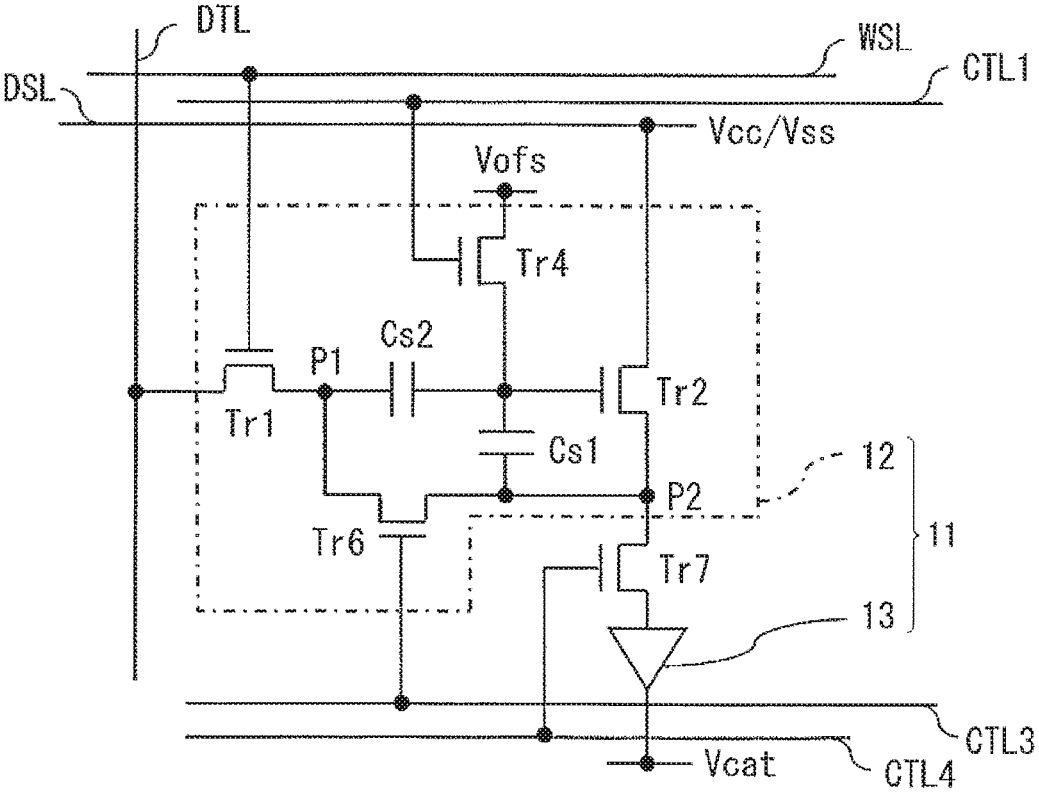
FIG. 21 illustrates an example of a circuit configuration of each of pixels illustrated in FIG. 20.

FIG. 20 illustrates a schematic configuration of a display unit 4 according to an embodiment of the disclosure. FIG. 21 illustrates an example of a circuit configuration of each of the pixels 11 in the display unit 4. The display unit 4 may correspond to a display unit in which a control scanner 34F is further provided and a switching transistor Tr7 is provided for each of the pixels 11 in the display unit 3 according to the above-described example embodiment. In one embodiment, the switching transistor Tr7 corresponds to a specific but non-limiting example of a "sixth switching transistor". The switching transistor Tr7 may include a gate that is coupled to a control line CTL4. The control line CTL4 may be coupled to an unillustrated output end of the control scanner 34F. The switching transistor Tr7 may be provided between the terminal P2 of the driving transistor Tr2 and the anode of the organic EL device 13, as illustrated in FIG. 21, for example.

The control scanner 34F may sequentially select the plurality of control lines CTL4 for each predetermined unit in response to (in synchronization with) an input of a control signal, for example. The control scanner 34F may be able to output two types of voltages (i.e., Von and Voff), for example. In a specific but non-limiting example, the control scanner 34F may supply the two types of voltages (Von and Voff) to each of the pixels 11 via corresponding one of the control lines CTL4. The ON voltage Von may be equal to or higher than the ON voltage of the switching transistor Tr7. The OFF voltage Voff may be lower than the ON voltage of the switching transistor Tr7.

Figure 22:
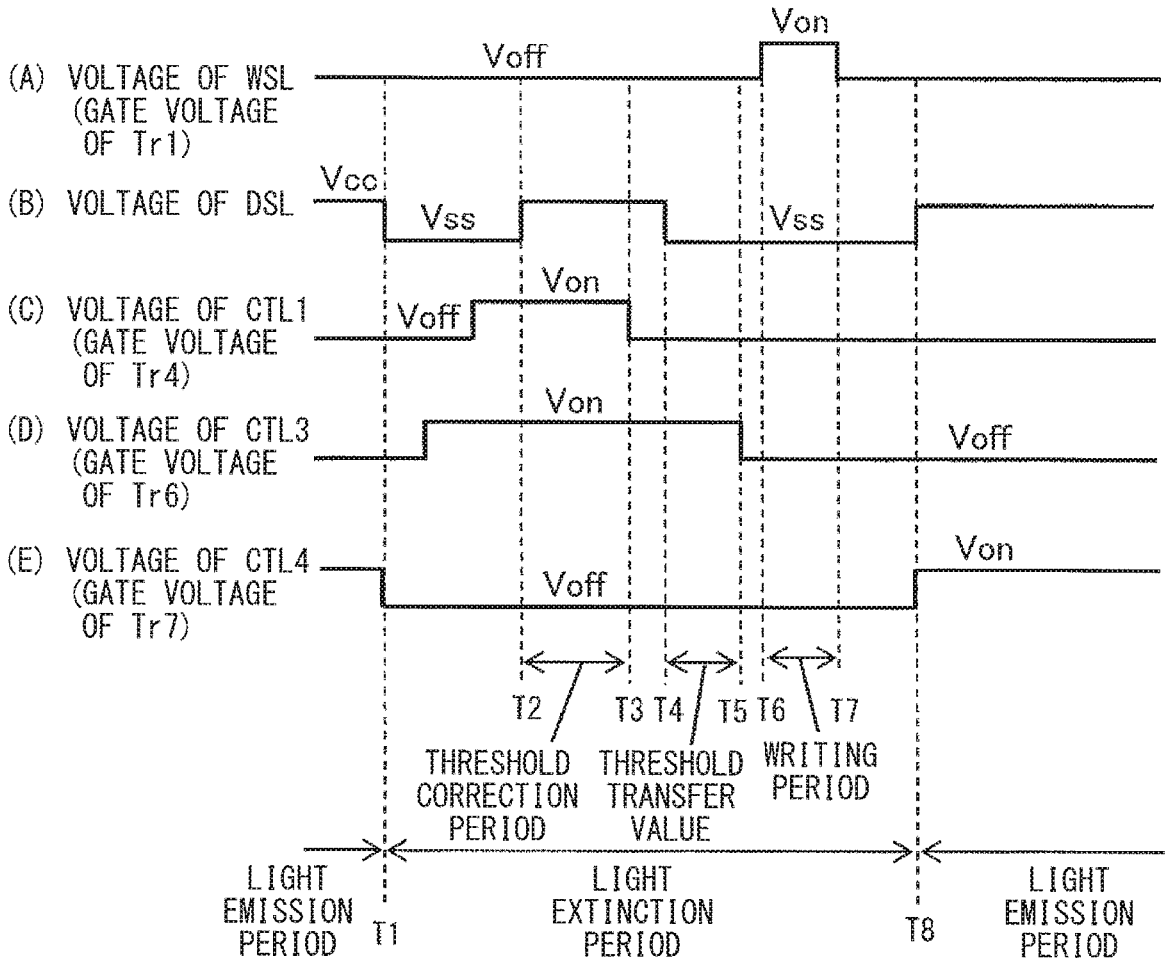
FIG. 22 illustrates an example of a temporal change in each of voltages to be applied to a scanning line and various control lines, when focusing on one pixel.

In the present example embodiment, the controller 20 and the driver 30 may cause the voltage of the power control line DSL to vary from the voltage Vcc to the voltage Vss, to thereby turn ON the switching transistor Tr6 (time T1), as illustrated in FIG. 22, for example. The controller 20 and the driver 30 may also cause the voltage of the control line CTL4 to vary from the voltage Von to the voltage Voff, to thereby turn OFF the switching transistor Tr7 (time T1), as illustrated in FIG. 22, for example. Thereafter, the controller 20 and the driver 30 may cause the voltage of the power control line DSL to vary from the voltage Vss to the voltage Vcc, and may cause the voltage of the control line CTL4 to vary from the voltage Voff to the voltage Von in the light emission period (time T8), as illustrated in FIG. 22, for example. This may cause a current to flow from the power control line DSL, and the organic EL device 13 to emit light. In other words, the controller 20 and the driver 30 may turn OFF the switching transistor Tr7, to thereby decouple the terminal P2 of the driving transistor Tr2 and the anode of the organic EL device 13 from each other, upon performing the threshold correction or writing, as illustrated in FIG. 22, for example. In a specific but non-limiting example, the controller 20 and the driver 30 performs the correction operation by turning ON and OFF the switching transistor Tr4, while the switching transistor Tr6 is turned ON and both the write transistor Tr1 and the switching transistor Tr7 are turned OFF, as illustrated in FIG. 22, for example. This configuration makes it possible to at least suppress fluctuations of a source potential of the driving transistor Tr2 upon writing the signal voltage Vsig to the gate of the driving transistor Tr2. This resultantly makes it possible to reduce the irregular luminance.

6. Fifth Example Embodiment

Configuration

Figure 23:
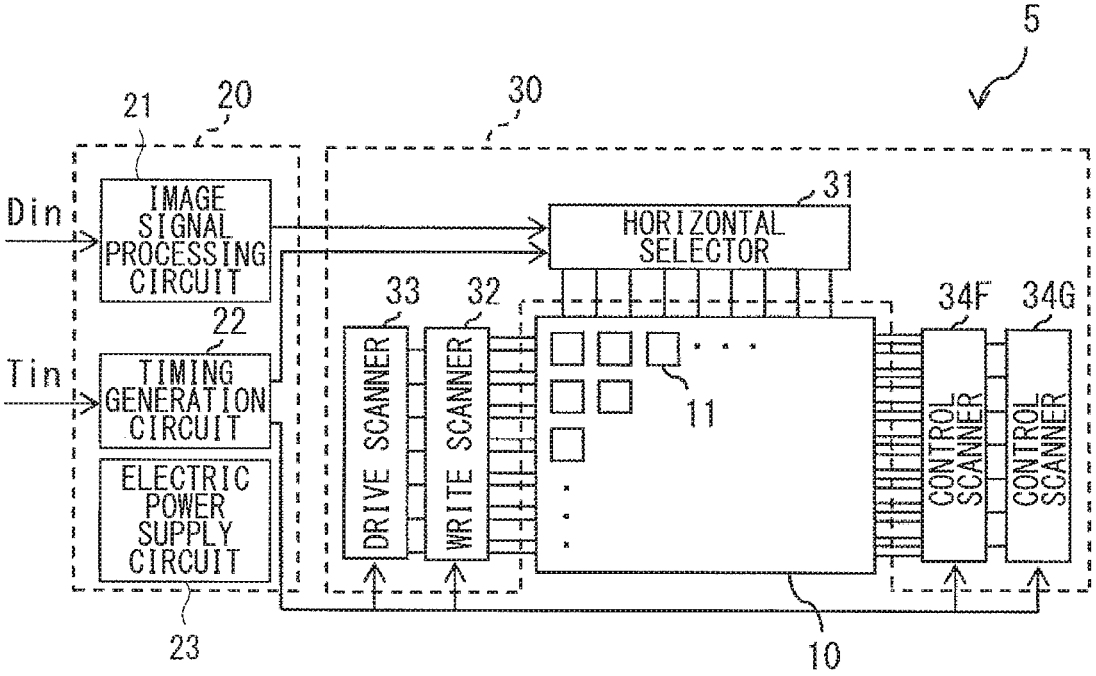
FIG. 23 is a schematic configuration diagram of a display unit according to one embodiment of the disclosure.
Figure 24:
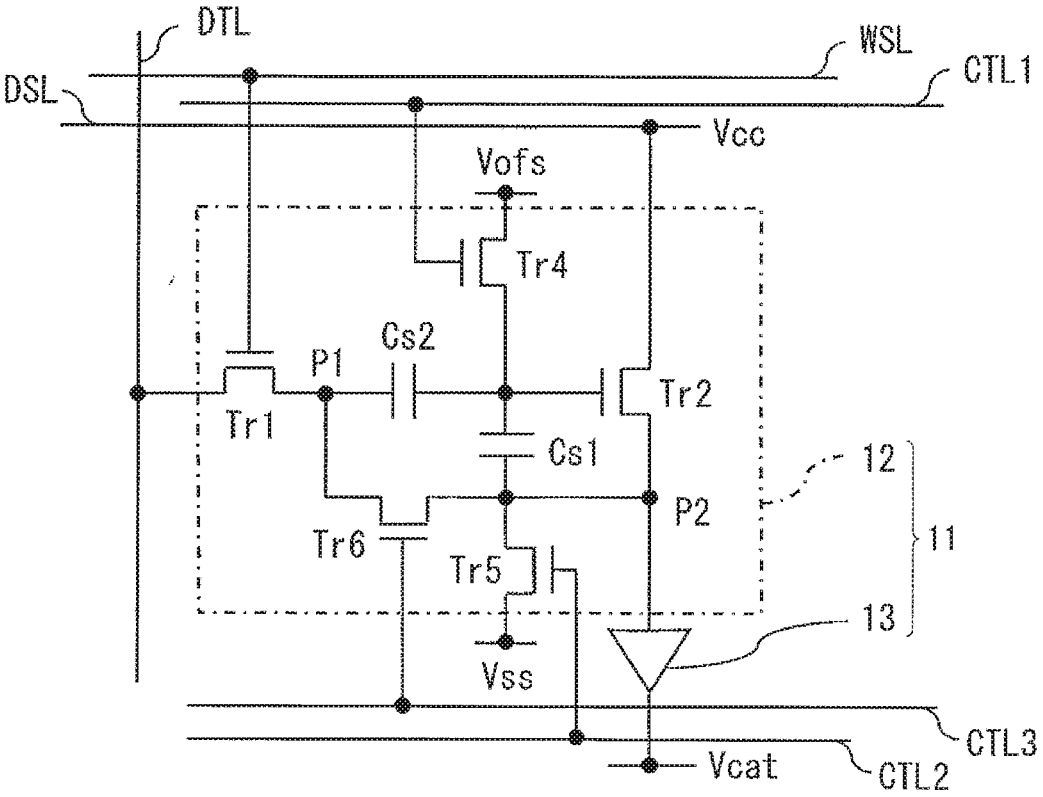
FIG. 24 illustrated an example of a circuit configuration of each of pixels illustrated in FIG. 23.
Figure 25:
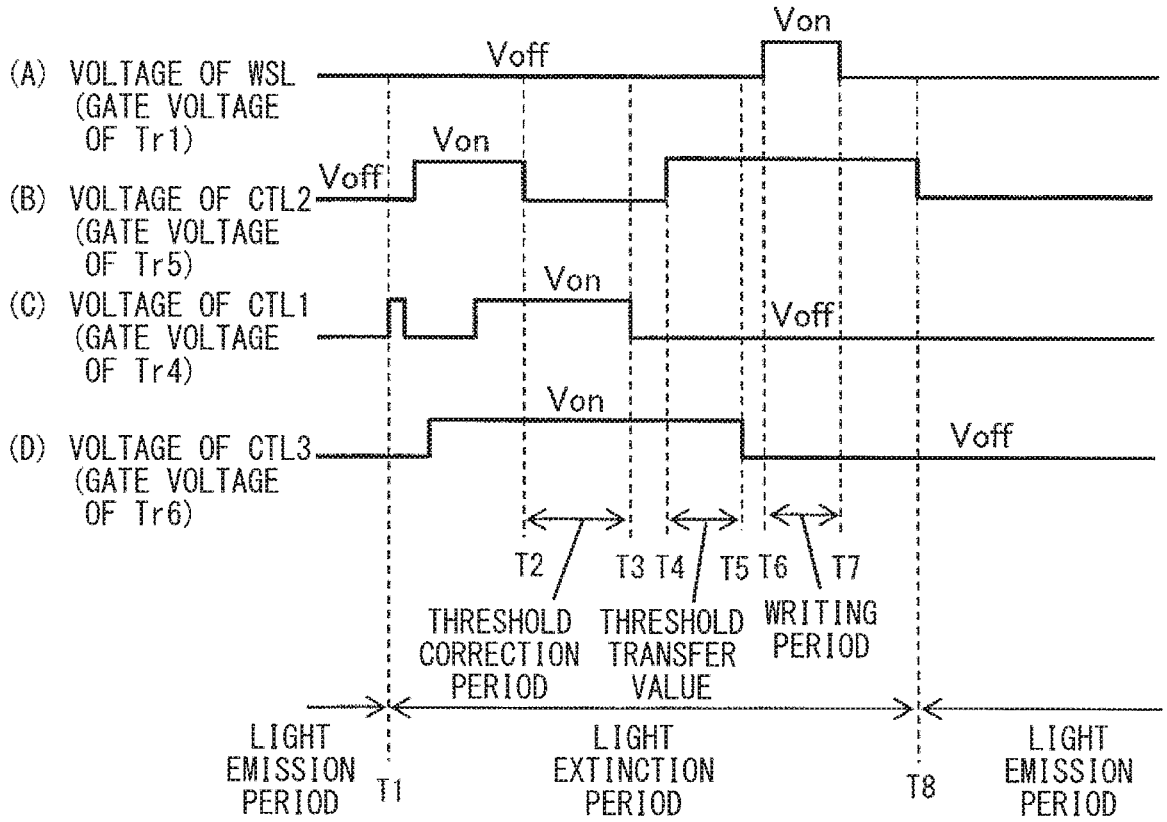
FIG. 25 illustrates an example of a temporal change to be applied to a scanning line and various control lines, when focusing on one pixel.

FIG. 23 illustrates a schematic configuration of a display unit 5 according to an embodiment of the disclosure. FIG. 24 illustrates an example of a circuit configuration of each of the pixels 11 in the display unit 5. The display unit 5 may correspond to a display unit in which a control scanner 34G is further provided and a switching transistor Tr5 is provided for each of the pixels 11 in the display unit 3 according to the above-described example embodiment. In one embodiment, the switching transistor Tr5 corresponds to a specific but non-limiting example of a "fourth switching transistor". The switching transistor Tr5 may include a gate that is coupled to the control line CTL2. The control line CTL2 may be coupled to an unillustrated output end of the control scanner 34G The switching transistor Tr5 may be provided at an electrically conductive path between the terminal P2 of the driving transistor Tr2 and the fixed voltage line VSS, as illustrated in FIG. 24, for example. The switching transistor Tr5 may control application of the fixed voltage Vss to the terminal P2 of the driving transistor Tr2.

The control scanner 34G may sequentially select the plurality of control lines CTL2 for each predetermined unit in response to (in synchronization with) an input of a control signal, for example. The control scanner 34G may be able to output two types of voltages (i.e., Von and Voff), for example. In a specific but non-limiting example, the control scanner 34G may supply the two types of voltages (Von and Voff) to each of the pixels 11 via corresponding one of the control lines CTL2. The ON voltage Von may be equal to or higher than the ON voltage of the switching transistor Tr5. The OFF voltage Voff may be lower than the ON voltage of the switching transistor Tr5. In the present example embodiment, the drive scanner 33 may be able to output the fixed voltage Vcc to the power control line DSL.

In the present example embodiment, the voltage of the power control line DSL may have the fixed voltage Vcc, and the pixel circuit 12 may include a configuration in which the fixed voltage Vss is coupled to the terminal P2 of the driving transistor Tr2 through the switching transistor Tr5, as illustrated in FIG. 24, for example. In the pixel circuit 12 according to the example embodiment, it is advantageous for the power control line DSL to have low resistance in order to avoid factors such as voltage drop. However, the power control line DSL needs to be wired in the same direction as the direction of a control line of a transistor. For this reason, achieving low resistance is relatively difficult in the third embodiment. In contrast, causing the power control line DSL to have the fixed voltage Vcc eliminates a need for wiring the power control line DSL in the same direction as the direction of the control line of the transistor. This makes it possible to relatively easily wire the power control line DSL with less resistance. In the present example embodiment, the controller 20 and the driver 30 may perform the correction operation by turning ON and OFF both the switching transistor Tr5 and the switching transistor Tr4 while the switching transistor Tr6 is turned ON and the write transistor Tr1 is turned OFF.

The pixel circuit 12 illustrated in FIG. 24 may adopt a drive system of extinguishing light of the organic EL device 13 by writing the voltage Vofs to the gate of the driving transistor Tr2 upon non-light emission. Further, the terminal P2 of the driving transistor Tr2 may be changed to the voltage Vss by means of the switching transistor Tr5 upon the signal writing, in the pixel circuit 12 illustrated in FIG. 24. Therefore, the gate-source voltage Vgs of the driving transistor Tr2 is prevented from being affected by the fluctuations of the cathode potential. This resultantly makes it possible to obtain uniform image quality without nonuniformity or crosstalk.

6. Application Example

A description is given below of an application example of any of the display units 1 to 5 according to the above-described example embodiments and the modification examples thereof (hereinafter, referred to as "the above-described example embodiments, etc."). The display units 1 to 5 of the above-described example embodiments are applicable to a display unit of an electronic apparatus in various fields, which may display an image signal supplied from the outside or an image signal generated inside, as an image or as a picture. Non-limiting examples of the electronic apparatus with such a display unit may include a television, a digital camera, a laptop personal computer, a portable terminal unit such as a mobile phone, and a video camera.

Figure 26:
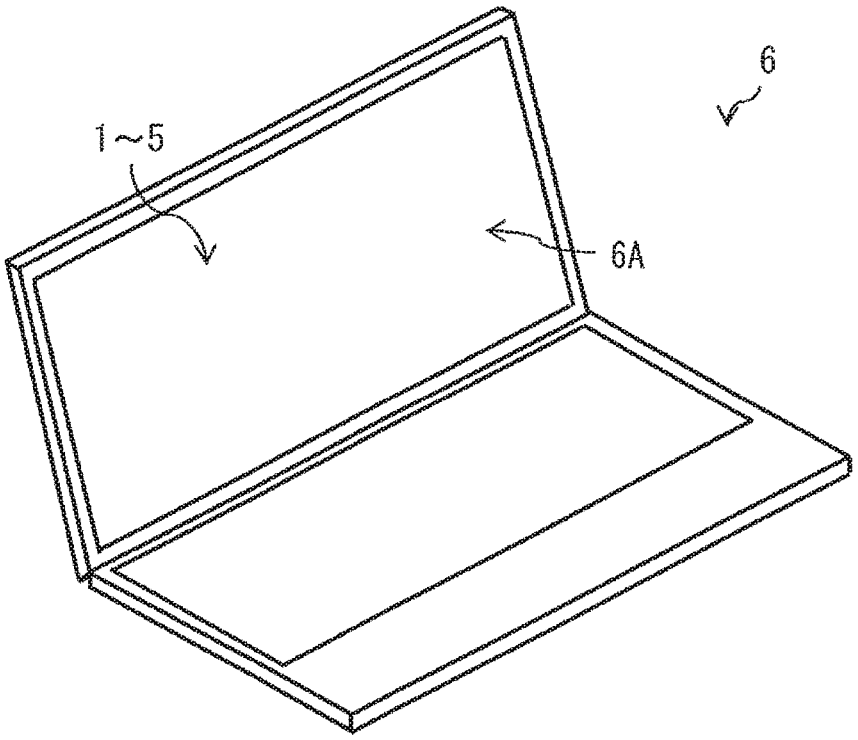
FIG. 26 is a perspective view of an outer appearance of one application example of a display unit according to any one of the above-mentioned embodiment and the modification example thereof.

FIG. 26 illustrates a schematic configuration example of an electronic apparatus 6 according to the present application example. The electronic apparatus 6 may be a laptop foldable personal computer including a display surface 6A on a main surface of one of two plate-shaped casings, for example. The electronic apparatus 6 may include any of the display units 1 to 5 according to the above-described example embodiment, etc., as well as the pixel array 10 at a location of the display surface 6A, for example. Any of the display units 1 to 5 is provided in the present application example, thus making it possible to reduce the irregular luminance.

Although the disclosure has been described hereinabove by way of example with reference to the example embodiment, the modification example, and the application example, the disclosure is not limited thereto but may be modified in a wide variety of ways. Moreover, the effects described hereinabove are mere examples. The effects according to an embodiment of the disclosure are not limited to those described hereinabove. The disclosure may further include other effects in addition to the effects described hereinabove.

It should be understood by those skilled in the art that various modifications, combinations, sub-combinations, and alterations may occur depending on design requirements and other factors insofar as they are within the scope of the appended claims or the equivalents thereof.

For example, the disclosure may also have the following configurations.

(1)

A pixel circuit including:

a driving transistor configured to control a current flowing in a light-emitting device;

a write transistor configured to control application of a signal voltage to a gate of the driving transistor, the signal voltage corresponding to an image signal;

a first switching transistor configured to control a gate voltage of the driving transistor upon correction operation that allows a gate-source voltage of the driving transistor to come close to a threshold voltage of the driving transistor;

a second switching transistor provided at an electrically conductive path between a first terminal of the driving transistor and a second terminal of the write transistor, the first terminal of the driving transistor being adjacent to the light-emitting device, the second terminal of the write transistor being adjacent to the driving transistor;

a first storage capacitor provided at an electrically conductive path between the gate of the driving transistor and the first terminal; and a second storage capacitor provided at an electrically conductive path between the gate of the driving transistor and the second terminal.

(2)

The pixel circuit according to (1), further including:

a third switching transistor configured to control a current flowing in the driving transistor; and a fourth switching transistor configured to control application of a fixed voltage to the first terminal.

(3)

The pixel circuit according to (1), further including a sixth switching transistor provided at an electrically conductive path between the first terminal and the light-emitting device.

(4)

The pixel circuit according to (1), further including a fourth switching transistor configured to control application of a fixed voltage to the first terminal.

(5)

A display unit provided with a plurality of pixels and a driving circuit, the plurality of pixels each including a light-emitting device and a pixel circuit, the driving circuit being configured to drive the plurality of pixels, the pixel circuit including:

a driving transistor configured to control a current flowing in a light-emitting device;

a write transistor configured to control application of a signal voltage to a gate of the driving transistor, the signal voltage corresponding to an image signal;

a first switching transistor configured to control a gate voltage of the driving transistor upon correction operation that allows a gate-source voltage of the driving transistor to come close to a threshold voltage of the driving transistor;

a second switching transistor provided at an electrically conductive path between a first terminal of the driving transistor and a second terminal of the write transistor, the first terminal of the driving transistor being adjacent to the light-emitting device, the second terminal of the write transistor being adjacent to the driving transistor;

a first storage capacitor provided at an electrically conductive path between the gate of the driving transistor and the first terminal; and a second storage capacitor provided at an electrically conductive path between the gate of the driving transistor and the second terminal.

(6)

The display unit according to (5), in which the driving circuit performs the correction operation by turning ON and OFF the first switching transistor and keeping a voltage corresponding to a threshold voltage of the driving transistor in the first storage capacitor and the second storage capacitor while the second switching transistor is turned ON and the write transistor is turned OFF.

(7)

The display unit according to (5), in which the pixel circuit further includes:

a third switching transistor configured to control a current flowing in the driving transistor; and a fourth switching transistor configured to control application of a fixed voltage to the first terminal, the first switching transistor is provided at an electrically conductive path between the gate of the driving transistor and a terminal of the driving transistor, the terminal of the driving transistor being adjacent to the third switching transistor, the driving circuit performs the correction operation by turning ON and OFF both the third switching transistor and the first switching transistor while the second switching transistor is turned ON and the write transistor is turned OFF.

(8)

The display unit according to (5), in which the pixel circuit further includes:

a sixth switching transistor provided at an electrically conductive path between the first terminal and the light-emitting device, the driving circuit performs the correction operation by turning ON and OFF the first switching transistor while the second switching transistor is turned ON and both the write transistor and the sixth switching transistor are turned OFF.

(9)

The display unit according to (5), in which the pixel circuit further includes:

a fourth switching transistor configured to control application of a fixed voltage to the first terminal, the driving circuit performs the correction operation by turning ON and OFF both the fourth switching transistor and the first switching transistor while the second switching transistor is turned ON and the write transistor is turned OFF.

(10)

The display unit according to any one of (6) to (9), in which the driving circuit is configured to apply a voltage corresponding to the signal voltage to a gate of the write transistor by turning ON the write transistor after performing the correction operation.

In the pixel circuit and the display unit according to one embodiment of the disclosure, the four transistors and the two storage capacitors are provided. The four transistors include the driving transistor, the write transistor, the first switching transistor, and the second switching transistor. The two storage capacitors include the first storage capacitor and the second capacitor. This configuration makes it possible to at least suppress fluctuations of a source potential of the driving transistor upon writing a signal voltage to the gate of the driving transistor.

In the pixel circuit and the display unit according to one embodiment of the disclosure, it is possible to at least suppress the fluctuations of the source potential of the driving transistor upon writing the signal voltage to the gate of the driving transistor. Accordingly, it is possible to reduce the irregular luminance. The effects of the disclosure are not limited to those described hereinabove. The disclosure may include some effects different from those described hereinabove and may further include additional effects.

Although the disclosure has been described in terms of exemplary embodiments, it is not limited thereto. It should be appreciated that variations may be made in the described embodiments by persons skilled in the art without departing from the scope of the disclosure as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" as used herein can allow for a degree of variability in a value or range. Moreover, no element or component in this disclosure is intended to be dedicated to the public regardless of whether the element or component is explicitly recited in the following claims.

What is claimed is:

1. A display unit provided with a plurality of pixels and a driving circuit, the plurality of pixels each including a light-emitting device and a pixel circuit, the driving circuit being configured to drive the plurality of pixels, the pixel circuit comprising:

a driving transistor configured to control a current flowing in a light-emitting device;

a write transistor configured to control application of a signal voltage to a gate of the driving transistor, the signal voltage corresponding to an image signal;

a first switching transistor configured to control a gate voltage of the driving transistor upon correction operation that causes a gate-source voltage of the driving transistor to approach a threshold voltage of the driving transistor;

a second switching transistor provided at an electrically conductive path between a first terminal of the driving transistor and a second terminal of the write transistor, the first terminal of the driving transistor being adjacent to the light-emitting device, the second terminal of the write transistor being adjacent to the driving transistor;

a first storage capacitor provided at an electrically conductive path between the gate of the driving transistor and the first terminal; and a second storage capacitor provided at an electrically conductive path between the gate of the driving transistor and the second terminal, wherein the driving circuit performs the correction operation by turning ON and OFF the first switching transistor and keeping a voltage corresponding to a threshold voltage of the driving transistor in the first storage capacitor and the second storage capacitor while the second switching transistor is turned ON and the write transistor is turned OFF.

2. The display unit according to claim 1, wherein the driving circuit applies a voltage corresponding to the signal voltage to a gate of the write transistor by turning ON the write transistor after performing the correction operation.

3. A display unit provided with a plurality of pixels and a driving circuit, the plurality of pixels each including a light-emitting device and a pixel circuit, the driving circuit being configured to drive the plurality of pixels, the pixel circuit comprising:

a driving transistor configured to control a current flowing in a light-emitting device;

a write transistor configured to control application of a signal voltage to a gate of the driving transistor, the signal voltage corresponding to an image signal;

a first switching transistor configured to control a gate voltage of the driving transistor upon correction operation that causes a gate-source voltage of the driving transistor to approach a threshold voltage of the driving transistor;

a second switching transistor provided at an electrically conductive path between a first terminal of the driving transistor and a second terminal of the write transistor, the first terminal of the driving transistor being adjacent to the light-emitting device, the second terminal of the write transistor being adjacent to the driving transistor;

a first storage capacitor provided at an electrically conductive path between the gate of the driving transistor and the first terminal; and a second storage capacitor provided at an electrically conductive path between the gate of the driving transistor and the second terminal, wherein the pixel circuit further comprises:

a third switching transistor configured to control a current flowing in the driving transistor; and a fourth switching transistor configured to control application of a fixed voltage to the first terminal, the first switching transistor is provided at an electrically conductive path between the gate of the driving transistor and a terminal of the driving transistor, the terminal of the driving transistor being adjacent to the third switching transistor, the driving circuit performs the correction operation by turning ON and OFF both the third switching transistor and the first switching transistor while the second switching transistor is turned ON and the write transistor is turned OFF.

4. The display unit according to claim 3, wherein the driving circuit applies a voltage corresponding to the signal voltage to a gate of the write transistor by turning ON the write transistor after performing the correction operation.

5. A display unit provided with a plurality of pixels and a driving circuit, the plurality of pixels each including a light-emitting device and a pixel circuit, the driving circuit being configured to drive the plurality of pixels, the pixel circuit comprising:

a driving transistor configured to control a current flowing in a light-emitting device;

a write transistor configured to control application of a signal voltage to a gate of the driving transistor, the signal voltage corresponding to an image signal;

a first switching transistor configured to control a gate voltage of the driving transistor upon correction operation that causes a gate-source voltage of the driving transistor to approach a threshold voltage of the driving transistor;

a second switching transistor provided at an electrically conductive path between a first terminal of the driving transistor and a second terminal of the write transistor, the first terminal of the driving transistor being adjacent to the light-emitting device, the second terminal of the write transistor being adjacent to the driving transistor;

a first storage capacitor provided at an electrically conductive path between the gate of the driving transistor and the first terminal; and a second storage capacitor provided at an electrically conductive path between the gate of the driving transistor and the second terminal, wherein the pixel circuit further comprises:

a sixth switching transistor provided at an electrically conductive path between the first terminal and the light-emitting device, the driving circuit performs the correction operation by turning ON and OFF the first switching transistor while the second switching transistor is turned ON and both the write transistor and the sixth switching transistor are turned OFF.

6. The display unit according to claim 5, wherein the driving circuit applies a voltage corresponding to the signal voltage to a gate of the write transistor by turning ON the write transistor after performing the correction operation.

7. A display unit provided with a plurality of pixels and a driving circuit, the plurality of pixels each including a light-emitting device and a pixel circuit, the driving circuit being configured to drive the plurality of pixels, the pixel circuit comprising:

a driving transistor configured to control a current flowing in a light-emitting device;

a write transistor configured to control application of a signal voltage to a gate of the driving transistor, the signal voltage corresponding to an image signal;

a first switching transistor configured to control a gate voltage of the driving transistor upon correction operation that causes a gate-source voltage of the driving transistor to approach a threshold voltage of the driving transistor;

a second switching transistor provided at an electrically conductive path between a first terminal of the driving transistor and a second terminal of the write transistor, the first terminal of the driving transistor being adjacent to the light-emitting device, the second terminal of the write transistor being adjacent to the driving transistor;

a first storage capacitor provided at an electrically conductive path between the gate of the driving transistor and the first terminal; and a second storage capacitor provided at an electrically conductive path between the gate of the driving transistor and the second terminal, wherein the pixel circuit further comprises:

a fourth switching transistor configured to control application of a fixed voltage to the first terminal, the driving circuit performs the correction operation by turning ON and OFF both the fourth switching transistor and the first switching transistor while the second switching transistor is turned ON and the write transistor is turned OFF.

8. The display unit according to claim 7, wherein the driving circuit applies a voltage corresponding to the signal voltage to a gate of the write transistor by turning ON the write transistor after performing the correction operation.

* * * * *